US011095392B2

(12) United States Patent
Morrow et al.

(10) Patent No.: US 11,095,392 B2
(45) **Date of Patent: *Aug. 17, 2021**

(54) HANDHELD PORTABLE COUNTERMEASURE DEVICE AGAINST UNMANNED SYSTEMS

(71) Applicant: Dedrone Holdings, Inc., San Francisco, CA (US)

(72) Inventors: Alexander Morrow, Gahanna, OH (US); Daniel E. Stamm, Columbus, OH (US); Raphael J. Welsh, Powell, OH (US); Daniel G. Loesch, Columbus, OH (US); Zachary Schmid, Columbus, OH (US)

(73) Assignee: Dedrone Defense, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/793,597

(22) Filed: Feb. 18, 2020

(65) Prior Publication Data

US 2020/0343992 A1 Oct. 29, 2020

Related U.S. Application Data

(63) Continuation of application No. 16/274,325, filed on Feb. 13, 2019, now Pat. No. 10,574,384, which is a (Continued)

(51) Int. Cl.
*H04K 3/00* (2006.01)
*G08B 6/00* (2006.01)

(Continued)

(52) U.S. Cl.
CPC ..... *H04K 3/92* (2013.01); *G08B 6/00* (2013.01); *G08B 7/06* (2013.01); *H01Q 21/22* (2013.01);

(Continued)

(58) Field of Classification Search
CPC ..... H04K 3/92; H04K 3/65; H04K 3/825; H04K 3/41; G08B 6/00; G08B 7/06; H01Q 21/22

(Continued)

(56) References Cited

U.S. PATENT DOCUMENTS 9,689,976 B2 6/2017 Parker et al.
9,715,009 B1 7/2017 Parker et al.

(Continued)

FOREIGN PATENT DOCUMENTS

WO 20160122739 A2 8/2016

*Primary Examiner* — Ayodeji O Ayotunde
(74) *Attorney, Agent, or Firm* — Morris, Manning & Martin, LLP; Daniel E. Sineway, Esq.; Adam J. Thompson, Esq.

(57) ABSTRACT

A portable countermeasure device is provided comprising one or more directional antennae, one or more disruption components and at least one activator. The portable countermeasure device further comprises a body having a dual-grip configuration, with the directional antennae are affixed to a removable plate on a front portion of the body. The one or more disruption components may be internally mounted within the device body. The dual-grip configuration allows an operator to use his body to steady and support the device while maintaining the antenna on target. The second grip is positioned adjacent the first grip, with the first grip angled toward the rear of the device and the second grip angled toward the front of the device. The portable countermeasure device is aimed at a specific drone, the activator is engaged, and disruptive signals are directed toward the drone, disrupting the control, navigation, and other signals to and from the drone.

20 Claims, 38 Drawing Sheets

Related U.S. Application Data continuation-in-part of application No. 16/005,905, filed on Jun. 12, 2018, now Pat. No. 10,790,925, which is a continuation of application No. 15/596,842, filed on May 16, 2017, now Pat. No. 10,020,909, which is a continuation-in-part of application No. 15/274,021, filed on Sep. 23, 2016, now Pat. No. 10,103,835.

(60) Provisional application No. 62/222,475, filed on Sep. 23, 2015.

(51) Int. Cl.
*G08B 7/06* (2006.01)
*H01Q 21/22* (2006.01)

(52) U.S. Cl.
CPC ..... *H04K 3/41* (2013.01); *H04K 3/65* (2013.01); *H04K 3/825* (2013.01); *H04K 3/42* (2013.01); *H04K 2203/22* (2013.01); *H04K 2203/24* (2013.01); *H04K 2203/32* (2013.01)

(58) Field of Classification Search
USPC ..... 455/1
See application file for complete search history.

(56) References Cited

U.S. PATENT DOCUMENTS

| | | | | |
|---|---|---|---|---|
| 9,977,117 | B2 | 5/2018 | Parker et al. | |
| 10,156,631 | B2 | 12/2018 | Parker et al. | |
| 10,281,570 | B2 | 5/2019 | Parker et al. | |
| 10,567,107 | B2 * | 2/2020 | Morrow | H04K 3/41 |
| 10,670,696 | B2 | 6/2020 | Parker et al. | |
| 10,739,451 | B1 | 8/2020 | Parker et al. | |
| 10,795,010 | B2 | 10/2020 | Parker et al. | |
| 10,907,940 | B1 | 2/2021 | Parker et al. | |

* cited by examiner

HANDHELD PORTABLE COUNTERMEASURE DEVICE AGAINST UNMANNED SYSTEMS

CROSS-REFERENCE TO RELATED APPLICATION

This application is a continuation of U.S. patent application Ser. No. 16/274,325 filed Feb. 13, 2019 and titled DUAL-GRIP PORTABLE COUNTERMEASURE DEVICE AGAINST UNMANNED SYSTEMS, which is a continuation-in-part of U.S. patent application Ser. No. 16/005,905 filed Jun. 12, 2018 and titled DUAL-GRIP PORTABLE COUNTERMEASURE DEVICE AGAINST UNMANNED SYSTEMS, which is a continuation of U.S. Pat. No. 10,020,909, filed May 16, 2017 and titled DUAL-GRIP PORTABLE COUNTERMEASURE DEVICE AGAINST UNMANNED SYSTEMS, which is a continuation-in-part of U.S. Pat. No. 10,103,835, filed Sep. 23, 2016 and titled PORTABLE COUNTERMEASURE DEVICE AGAINST UNMANNED SYSTEMS, which claims priority to U.S. Provisional Patent Application Ser. No. 62/222,475, filed Sep. 23, 2015, titled ELECTRONIC DRONE DEFENDER-WIRELESS JAMMING AND SIGNAL HACKING, the disclosures of which are each incorporated by reference in their entireties herein.

BACKGROUND

The following relates generally to the electronic countermeasure arts, the unmanned autonomous vehicle arts, signal jamming arts, communications arts, satellite navigation and communication arts, law enforcement arts, military science arts, and the like. It finds particular application in conjunction with the jamming and hijacking of drones and will be described with particular reference thereto. However, it will be understood that it also finds application in other usage scenarios and is not necessarily limited to the aforementioned application.

Unmanned or autonomous aerial vehicles ("UAV), more commonly known as "drones", have become more and more prevalent in both the military and civilian context. Current, commercially available drones embody technology that was until recently, solely within the purview of governmental entities. The drones available to the civilian and military markets include navigation systems, various types of eavesdropping components, high-definition or real-time video output, long-life lithium batteries, and the like. Furthermore, current civilian models may be operated by any individual, without regard to licensing or regulation.

The propagation of civilian drone usage has resulted in invasions of privacy, interference with official governmental operations, spying on neighbors, spying on government installations, and myriad other offensive operations. Military usage of drones, including armed drones, has increased substantially as battery storage has increased and power consumption has decreased. This widespread use of drones has led to security and privacy concerns for the military, law enforcement, and the private citizen. Furthermore, drones have substantially decreased in size, becoming smaller and smaller, while the capabilities of the drones themselves have increased. This poses a security risk for security personnel as the pilot of the drone may be far away, making the determination of the pilot's intent particularly difficult to ascertain.

The drones in use typically operate using multiple frequency bands, some bands used for control signals between the drone and the pilot, bands for Global Navigation Satellite System ("GNSS") signals for navigation including, for example and without limitation, GPS, GLONASS, Galileo (EU), BeiDou Navigation Satellite System ("BDS"), and other public/proprietary satellite-based navigation systems, and other frequency bands for video and/or audio signal transmissions. This use of multiple frequencies results in difficulty in effectively tailoring a jamming signal directed solely to the offending drone, without negatively impacting other, non-offensive radio-frequency devices.

Furthermore, current commercially available jammers are generally omnidirectional in nature. To avoid issues relating to non-offensive devices, these jammers typically are limited in radius from less than a meter to 25 meters. Those jammers having larger effective radii for signal jamming or denial require substantial power (plug-in/non-portable) or are bulky. A common problem with current jammers is their inability to specifically target a drone, while allowing non-threatening devices to remain operational. Furthermore, due to the distances and heights at which drones operate, the portable jammers that are currently available lack the ability to effectively jam signals that may be used by the drones. For example, such commercially available jammers for Wi-Fi or satellite navigation will propagate a jamming signal circularly outward, rendering the operator's own devices inoperable while within that radius. The unintended consequences of such jamming may cause vehicle accidents or aircraft issues, depending upon the strength and radius of the jammer being used.

In addition to the foregoing problems, current jammers lack the ruggedness associated with field operations. That is, the commercially available jammers are delicate electronics and are not designed for use by soldiers in the field. As noted above, the commercially available jammers further utilize multiple antennae, each directed to a different frequency band. These are not ruggedized pieces of equipment capable of being utilized in field operations by law enforcement, security, or military. The multiple antennae are prone to breakage during transport. Those rugged military or law enforcement jammers that are available are portable in the sense that they are backpack or vehicle born devices and require substantial training to effectively operate.

Previous attempts at hand-held or portable jammers utilized standard form-factors for hand-held weapons. However, these designs are intended to compensate for recoil as the weapon fires. Rifle form-factors typically utilize a two-hand approach, with the hands being spaced apart to steady the rifle when firing. This hand placement, with the weight of the average weapon, can be tiring, particularly when holding the weapon on target. Generally, because the weapon fires so quickly, the aforementioned design does not necessarily adversely affect its use. However, with directed energy weapons, which must remain on target while active, this displacement of at least one of the hands away from the body of the operator, places considerable strain on the extended arm.

Thus, it would be advantageous to provide a ruggedized form factor directional drone jammer that provides a soldier or law enforcement officer with simple, targeted anti-drone capabilities. Such a jammer is portable, including a power supply, and comprises a rifle-like form allowing the soldier or law enforcement officer to aim via optic, electronic or open sights at a target drone for jamming of the drone control and/or GNSS signals, while preventing interference for other devices utilizing the jammed frequencies. Furthermore, it would be advantageous to provide a suitable form-factor that relieves arm strain while maintaining aim on a targeted drone.

BRIEF DESCRIPTION

The following discloses a new and improved portable countermeasure device, utilizing a dual-grip embodiment, with directional targeting which addresses the above referenced issues, and others.

In one embodiment, a portable countermeasure device is provided comprising at least one directional antenna, at least one disruption component and at least one activator. The countermeasure device further includes a processor and memory in communication therewith wherein the memory stores instructions which are executed by the processor to monitor a system performance by measuring at least one performance indicator of the countermeasure device.

In another embodiment, the portable countermeasure device includes a haptic feedback component in communication with the processor configured to generate a haptic feedback pattern associated with the measured performance indicator.

In some embodiments, the measured performance indicator is at least one of a temperature, a machine state log, a battery power level, a transmission signal, a GNSS position, a time count, or an output power level, wherein the device further comprises a GNSS receiver or at least one temperature sensor in communication with the processor configured to detect a temperature of the countermeasure device.

In another embodiment, the measured performance indicator is recorded to a data log within the memory or onto a removable data storage device.

In another embodiment, a portable countermeasure device is provided having a hand-held form factor with dual-grips, the grips located adjacent each other.

According to another embodiment, a dual-grip portable countermeasure device includes a body having a first grip and a second grip, with the second grip adjacent to the first grip located on a bottom portion of the body. The dual-grip portable countermeasure device further includes at least one directional antenna affixed to a plated removably coupled to a front portion of the body, and at least one signal disruption component disposed within an interior of the body, the at least one signal disruption component in electronic communication with the at least one directional antenna.

In accordance with another embodiment, a dual-grip portable countermeasure device, includes a body that has a first grip located on a bottom portion of the body, a second grip adjacent the first grip located on the bottom portion of the body, and a hollow buttstock with a buttstock cavity formed in a rear portion of the body, with the first grip angled toward a buttstock of the body, and the second grip is angled opposite the first grip toward the front of the body. The dual-grip portable countermeasure device also includes a connector located within the buttstock cavity, the connector configured to removably couple with a power supply. Disruption components are located within the body and are in communication with the external power supply via the connector, the disruption components configured to generate a disruption signals on corresponding associated frequency bands. The dual-grip portable countermeasure device also includes a first activator coupled to the body adjacent the first grip and in operable communication with the external power supply and at least one of the disruption components. The dual-grip portable countermeasure device also includes multiple directional antennae in communication with the disruption components, the directional antennae configured to emit a corresponding plurality of disruption signals generated by the plurality of disruption components.

In another aspect, the portable countermeasure device further comprises a firearm form factor body, wherein the directional antenna is affixed to removable plate removably attached to a front portion of the firearm form factor body. The one or more disruption components may be externally or internally mounted to the firearm form factor body.

In another aspect, a power source is capable of being inserted into the buttstock cavity so as to supply power to the disruption components. Such a battery pack may comprise a lithium-ion battery, NiMH battery, or the like.

In yet another aspect, the disruption components generate disruptive signals across multiple frequency bands via at least one antenna. In some embodiments, the multiple frequency bands include GNSS, control signals, and/or Wi-Fi signals. In other embodiments, multiple antennae are used for different frequency bands.

In another aspect, a measured performance indicator is recorded to a data log within a memory or removable data storage device.

In another aspect, the processor is further configured to attenuate the output power of the amplified signal by one of pulse width modulation, voltage control of the at least one amplifier, a variable voltage attenuator, and waveform control.

In another aspect, the disruption signals including at least one of noise, spoofing, or alternate control commands are stored within the memory.

BRIEF DESCRIPTION OF THE DRAWINGS

The subject disclosure may take form in various components and arrangements of component, and in various steps and arrangement of steps. The drawings are only for purposes of illustrating the preferred embodiments and are not to be construed as limiting the subject disclosure.

DETAILED DESCRIPTION

Figure 1:
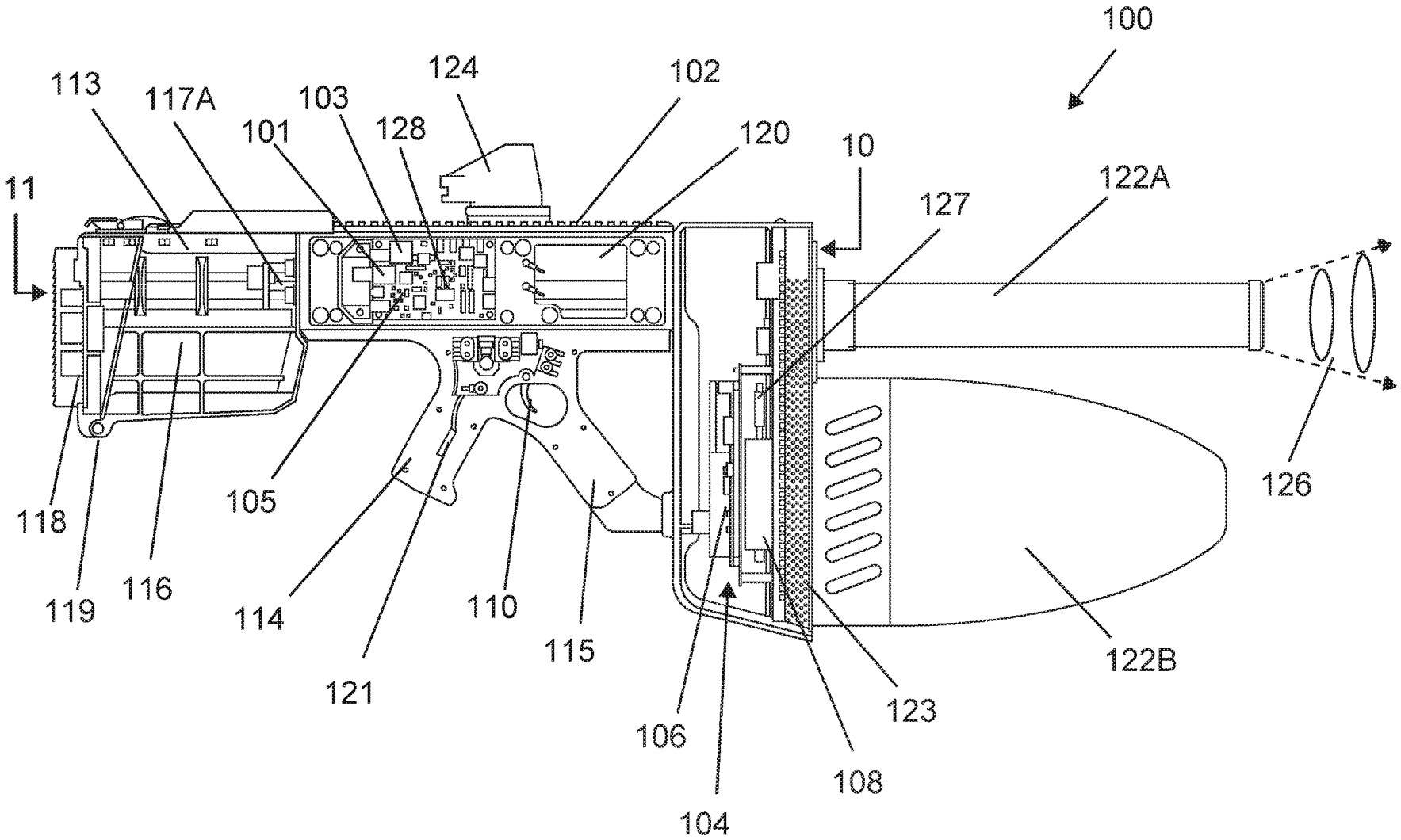
FIG. 1 illustrates a cross section of a portable countermeasure device in accordance with one aspect of the exemplary embodiment.

One or more embodiments will now be described with reference to the attached drawings, wherein like reference numerals are used to refer to like elements throughout. Aspects of exemplary embodiments related to systems and methods for signal jamming and signal hijacking are described herein. In addition, example embodiments are presented hereinafter referring to a rifle-like apparatus that may be aimed by a soldier or law enforcement officer on a drone to disrupt control and/or navigation of the drone, however application of the systems and methods set forth can be made to other areas utilizing electronic countermeasures and privacy protection.

As described herein, there is described a portable countermeasure device, such as rifle-like or firearm form factor jammer, that can be aimed by an operator at a drone, resulting in the disruption of control and/or navigation signals. In one embodiment, the portable countermeasure device includes multiple signal generators and associated amplifiers, producing disruptive, spoofing and/or jamming signals across multiple frequency bands. It will be appreciated by those skilled in the art that suitable disruptive signals may include, for example and without limitation, multi- or single frequency noise signals, alternative command signals, false data signals, and the like. In such an embodiment, at least one antenna is coupled to the portable countermeasure device, capable of directing multiple frequency bands of disruptive signals toward a single target, forming a cone around the target. The portable countermeasure device may be self-contained, with replaceable battery packs, or receive power from an external source.

It will be appreciated that the various components of the portable countermeasure device, as described in greater detail below, may be added to an existing fire arm, an aftermarket rifle stock, or a firearm-like form factor having a customized body incorporating the various components. The portable countermeasure device may be aimed via at least one sight device including, iron sights, an optical scope, or other means for directing the disruptive signals toward a targeted drone. Furthermore, the embodiments disclosed herein may be implemented without complex software, hardware, enabling a soldier or law enforcement officer to use the portable countermeasure device without substantial training. Such a simplified implementation further ruggedizes the portable countermeasure device for use in harsh environments where weather, lack of resupply, insurgents, criminals, or the like, may operate.

Referring now to FIG. 1, there is shown a cross-section of a portable countermeasure device 100 in accordance with one exemplary embodiment of the subject application. As illustrated in FIG. 1, the portable countermeasure device 100 may be implemented in a firearm-like form factor, providing ease of use and familiarization to the operator. Accordingly, the portable countermeasure device 100 provides a soldier or law enforcement officer (operator) with the ability to specifically target a particular drone with disruptive signals, while minimizing the impact of the generated signal on other, non-targeted devices. It will be appreciated that the various components depicted in FIG. 1 are for purposes of illustrating aspects of the exemplary hardware are capable of being substituted therein.

It will be appreciated that the portable countermeasure device 100 of FIG. 1 is capable of implementation in a variety of handheld or portable form factors and the illustrations depicted and discussed hereinafter provide exemplary, and non-limiting, form factors contemplated hereunder. As shown in FIG. 1, the portable countermeasure device 100 comprises a body 102 including a processor 101 that executes, a memory 103 that stores computer-executable instructions for providing the various functions, calculations, selections and the like described herein, and signal disruption components 104 in communication therewith, e.g., at least one signal generator 106 and at least one amplifier 108. The processor 101 and memory 103 are physically coupled together with various other electronic components via microprocessor board 105.

The processor 101 can be any of various commercially available processors. The at least one processor 101 can be variously embodied, such as by a single-core processor, a dual-core processor (or more generally by a multiple-core processor), a digital processor and cooperating math coprocessor, a digital controller, or the like. The processor 101, in addition to controlling the operation of the countermeasure device 100, executes instructions stored in memory 103 for performing the various functions described more fully below.

The memory 103 may represent any type of non-transitory computer readable medium such as random-access memory (RAM), magnetic disk or tape, optical disk, flash memory, or holographic memory. In one embodiment, the memory 103 comprises a combination of random-access memory and read only memory. In some embodiments, the processor 101 and memory 103 may be combined in a single chip. Memory 103 may store data the processed in the method as well as the instructions for performing various exemplary functions.

The memory 103 suitably includes firmware, such as static data or fixed instructions, such as BIOS, system functions, configuration data, and other routines used for the operation of the countermeasure device 100 via the processor 101. The memory 103 is further capable of providing a storage area for data and instructions associated with applications and data handling accomplished by the processor 101. The memory 103 may further include one or more instructions, or modules, configured to be executed by the processor 101 to perform one or more operations, such as operations associated with the countermeasure device 100, which operations are described in greater detail below.

The illustration of FIG. 1 depicts a portable countermeasure device 100 that utilizes a dual-grip configuration, having a first grip 114 in location typical with the typical pistol-grip rifle, and second grip 115 in relatively close proximity to the first grip 114. In some embodiments, as illustrated hereinafter, the first and second grips 114 and 115 may be adjacent to each other, with the second grip 115 cantilevered or angled forward, towards the front 10 of the device 110 and the first grip 114 cantilevered or angled back towards the rear 11 of the device 110. In other embodiments, as will be appreciated by those skilled in the art, the body 102 may, for example and without limitation, resemble a commonly used rifle, including, without limitation, M4 carbine, M14, AR-platform, or the like, comprising an upper receiver and a lower receiver, as well as other rifle designs, as will be appreciated by those skilled in the art including, for example, modular rifle designs, standard rifle designs, and the like. Depending upon the configuration of the portable countermeasure device 100, the microprocessor board 105 and/or the signal disruption components 104 may be contained in the upper receiver, the lower receiver, or both.

Figure 12A:
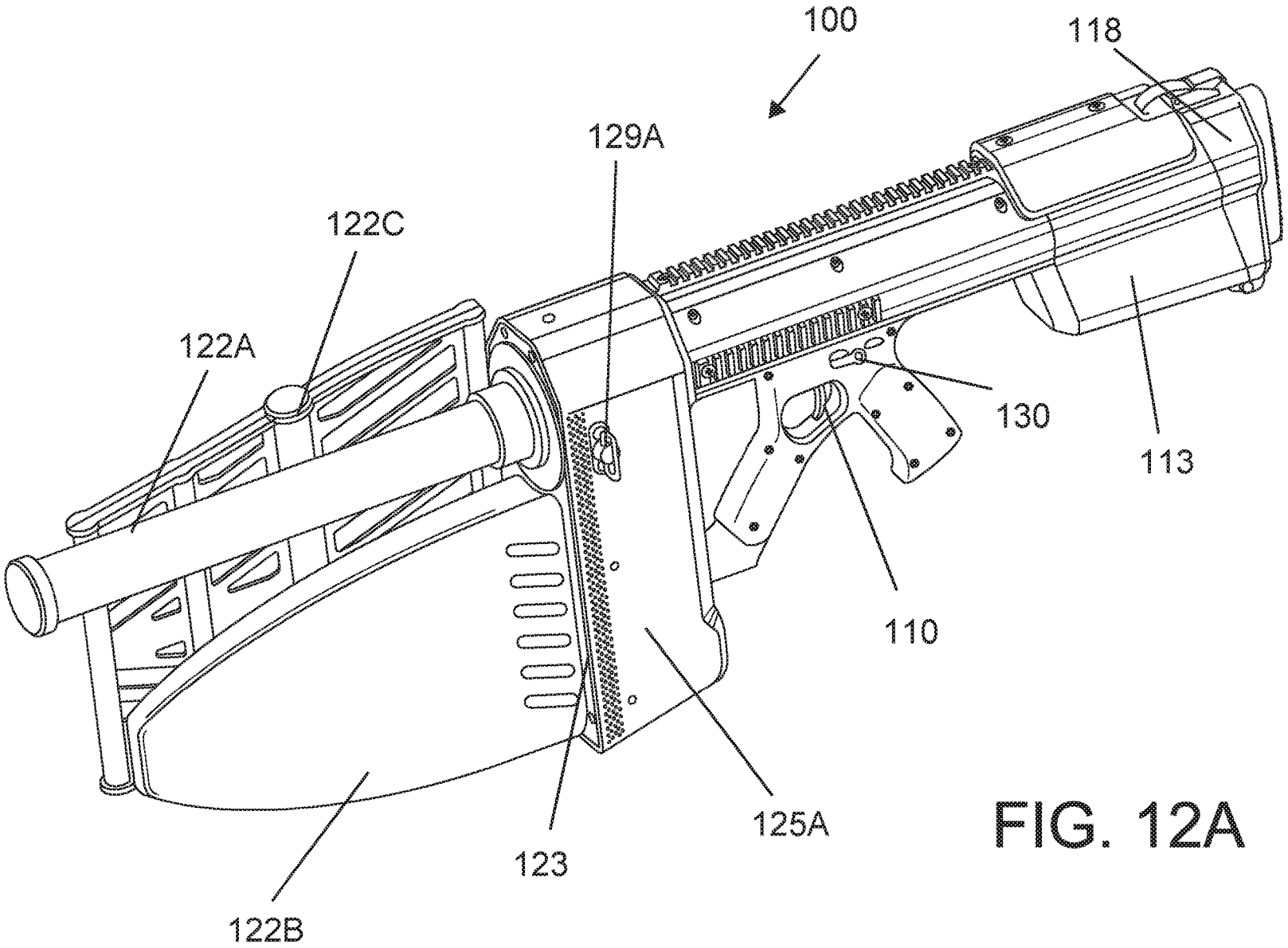
FIG. 12A illustrates a perspective of the portable countermeasure device of FIG. 1 in accordance with one aspect of the exemplary embodiment.
Figure 12B:
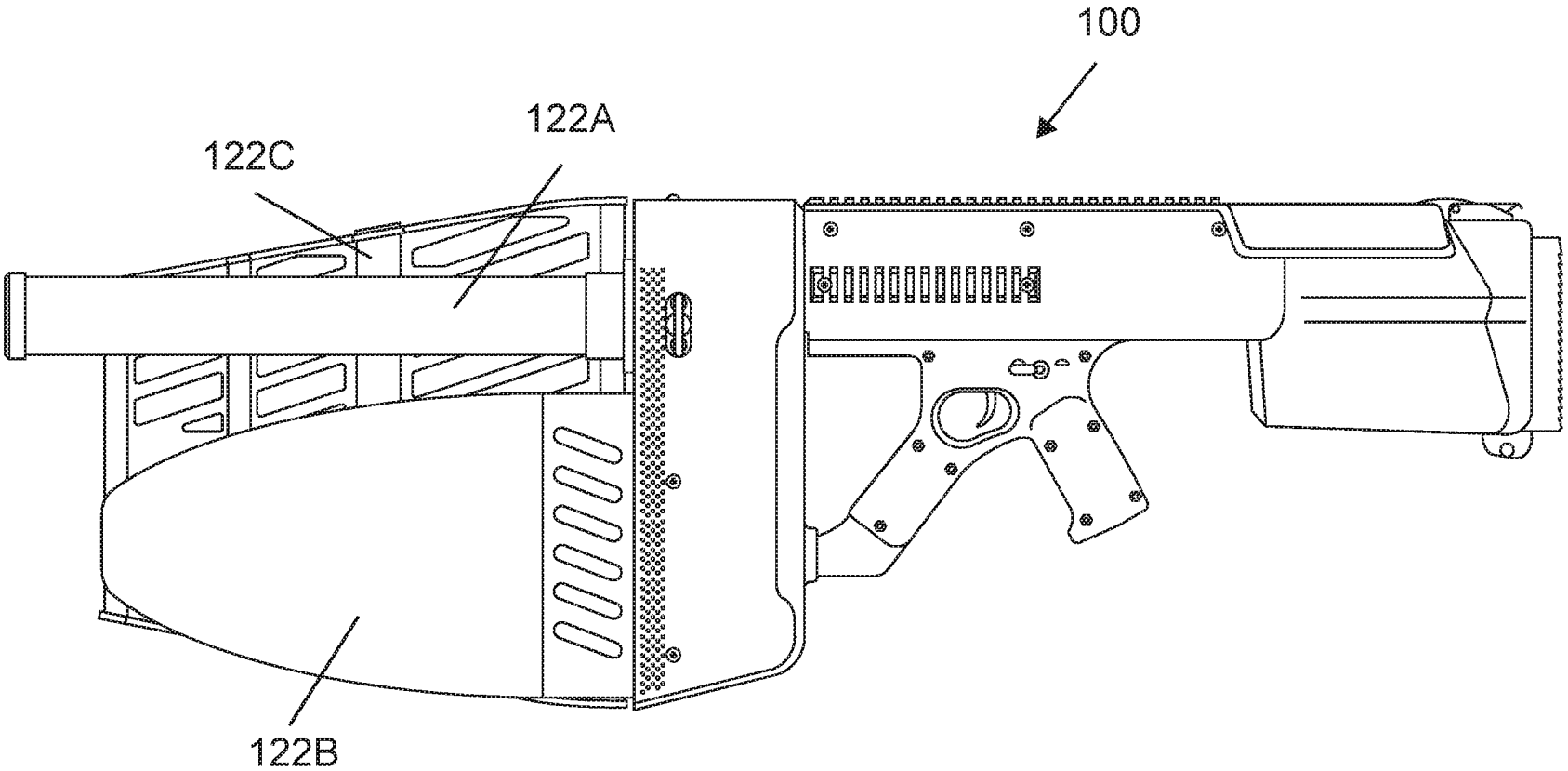
FIG. 12B illustrates a left-side view of the example portable countermeasure device of FIG. 12A according to one embodiment of the subject application.
Figure 12D:
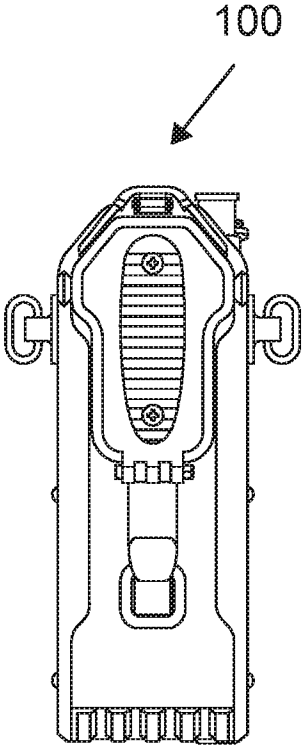
FIG. 12D illustrates a rear three-dimensional view of the example portable countermeasure device of FIG. 12A according to one embodiment of the subject application.
Figure 12C:
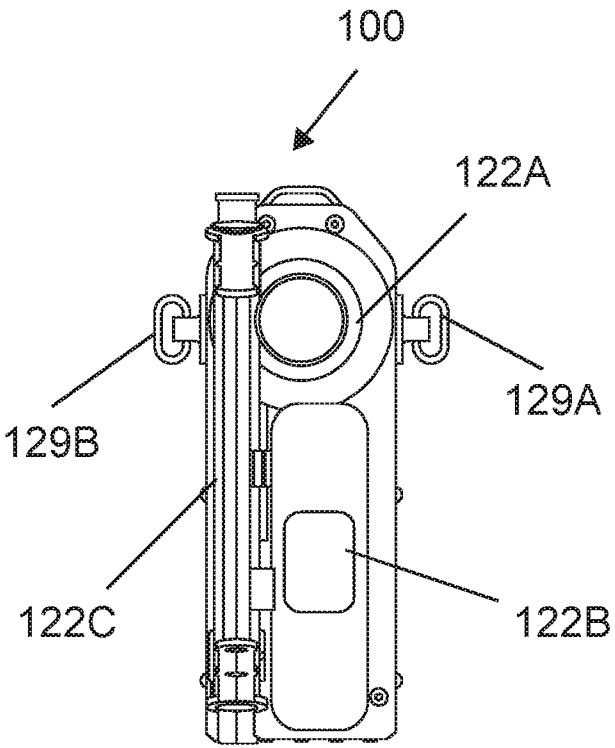
FIG. 12C illustrates a front three-dimensional view of the example portable countermeasure device of FIG. 12A according to one embodiment of the subject application.
Figure 12E:
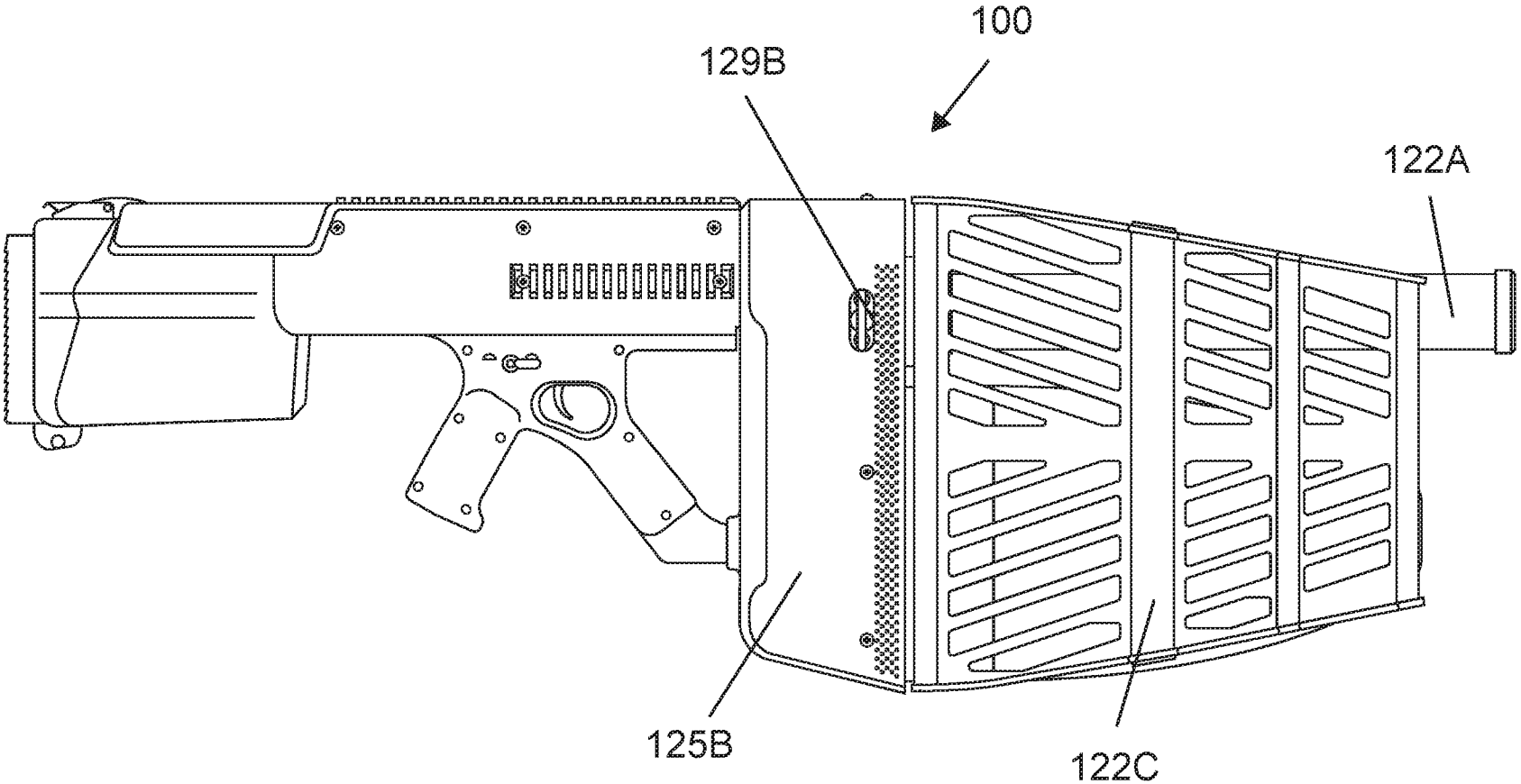
FIG. 12E illustrates a right-side view of the example portable countermeasure device of FIG. 12A according to one embodiment of the subject application.
Figure 12F:
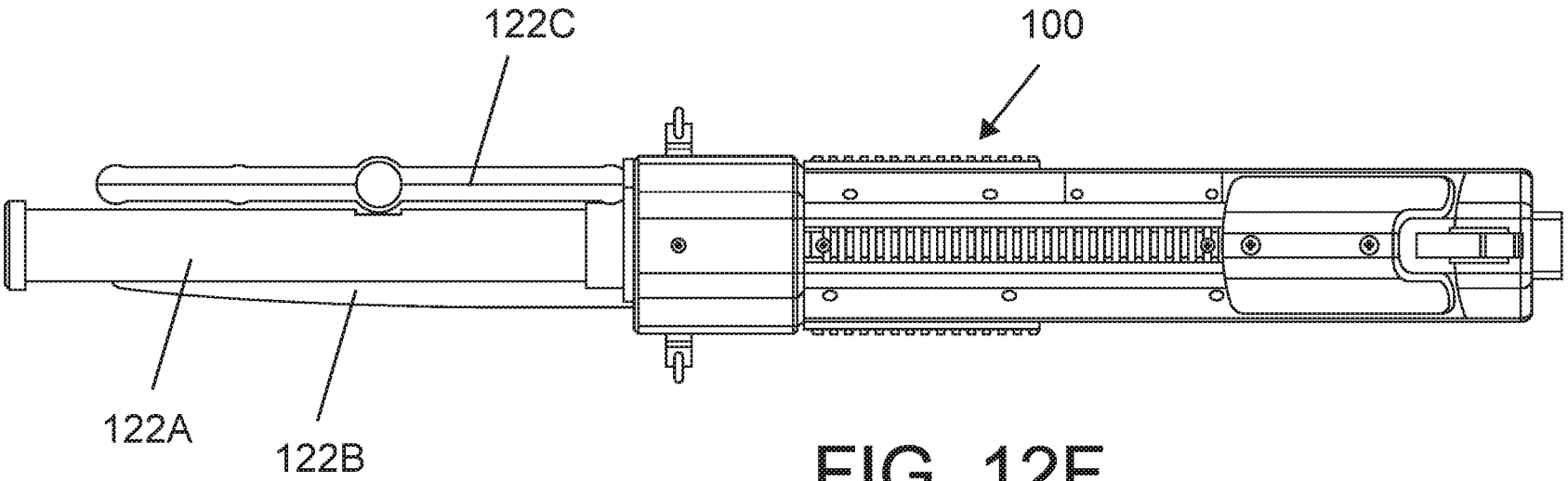
FIG. 12F illustrates a top three-dimensional view of the example portable countermeasure device of FIG. 12A according to one embodiment of the subject application.
Figure 12G:
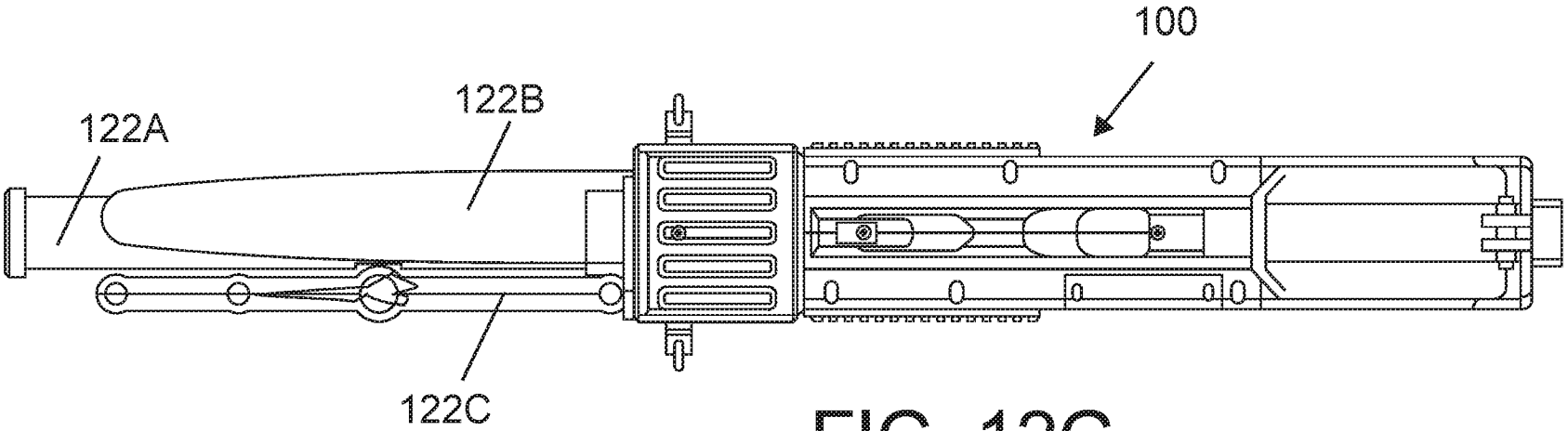
FIG. 12G illustrates a bottom three-dimensional view of the example portable countermeasure device of FIG. 12A according to one embodiment of the subject application.

The body 102 may be constructed of non-metallic materials, i.e., ballistic plastic, carbon fiber, ceramics, etc., or suitable non-transmissive metallic composites. The body 102 may be implemented in a suitable form factor with which soldiers and/or law enforcement personnel are already familiar, e.g., the aforementioned M4 carbine, AR-platform, AK-platform, SCAR, bullpup, etc. It will be appreciated that the width, length, and height of the body 102 may be dependent upon the size and number of generators 106 and amplifiers 108 either integral therein or externally affixed thereto. According to one embodiment, a multifunctional cell is formed as the body 102 to provide both structural support/shape of the portable countermeasure device 100 as well as supply power to the components therein. A suitable example of such a multifunctional cell is provided in PCT/US2013/040149, filed May 8, 2013 and titled MULTI-FUNCTIONAL CELL FOR STRUCTURAL APPLICATIONS, the entire disclosure of which is incorporated by reference herein. In accordance with another embodiment, the portable countermeasure device 100 may include multiple signal disruption components 104 to combat a variety of potential targets, e.g., receivers of improvised explosive devices (IEDs), commercial drones, military drones, or other portable electronic devices of enemy combatants or suspects, e.g., cellular phones, GNSS-based navigation devices, remote control detonators, etc. A suitable example of a portable countermeasure device 100 that includes multiple signal disruption components 104 within the body 102 is depicted in FIG. 12A et seq., as discussed below.

Figure 2A:
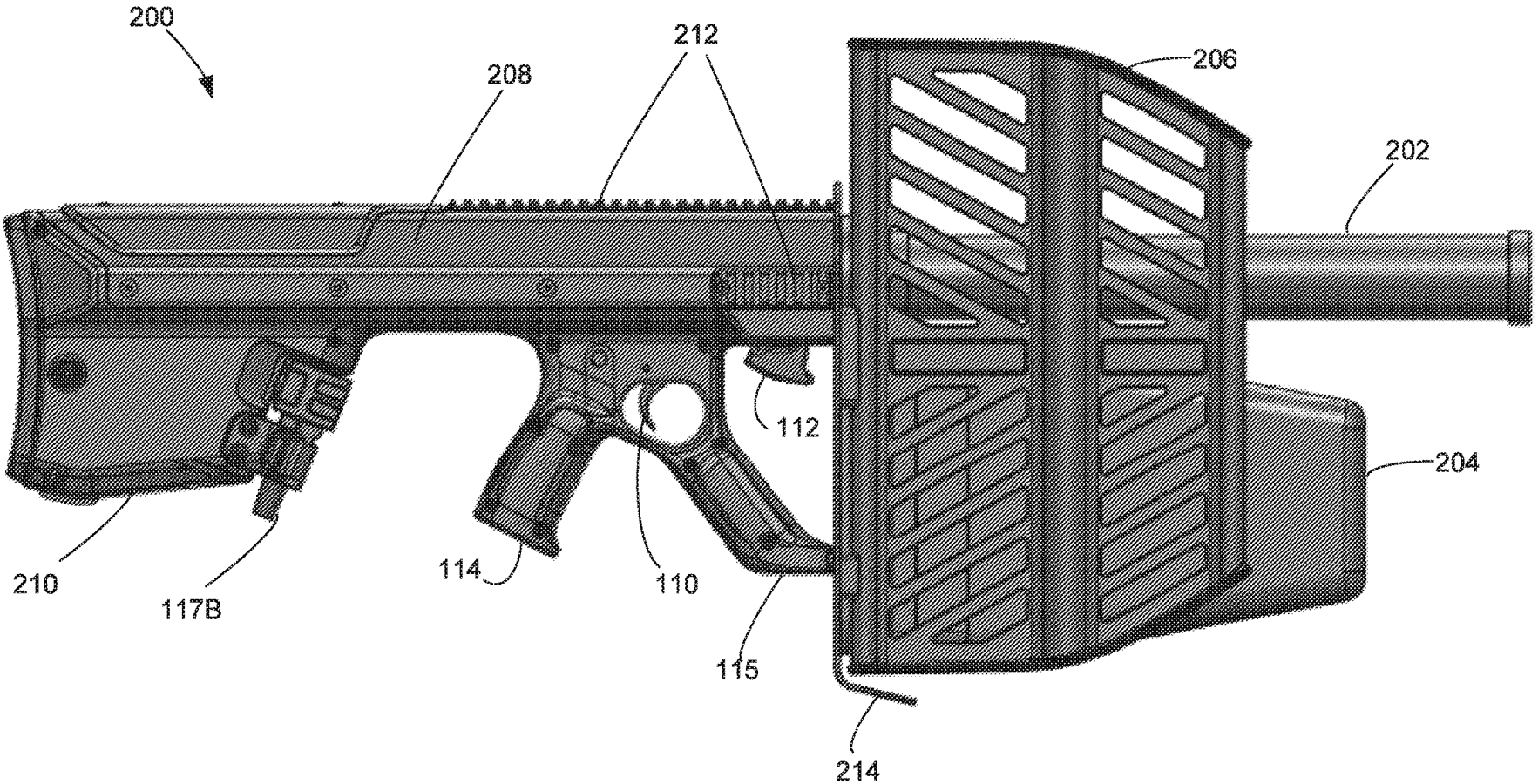
FIG. 2A illustrates a right-side three-dimensional view of an example portable countermeasure device according to one embodiment of the subject application.
Figure 2B:
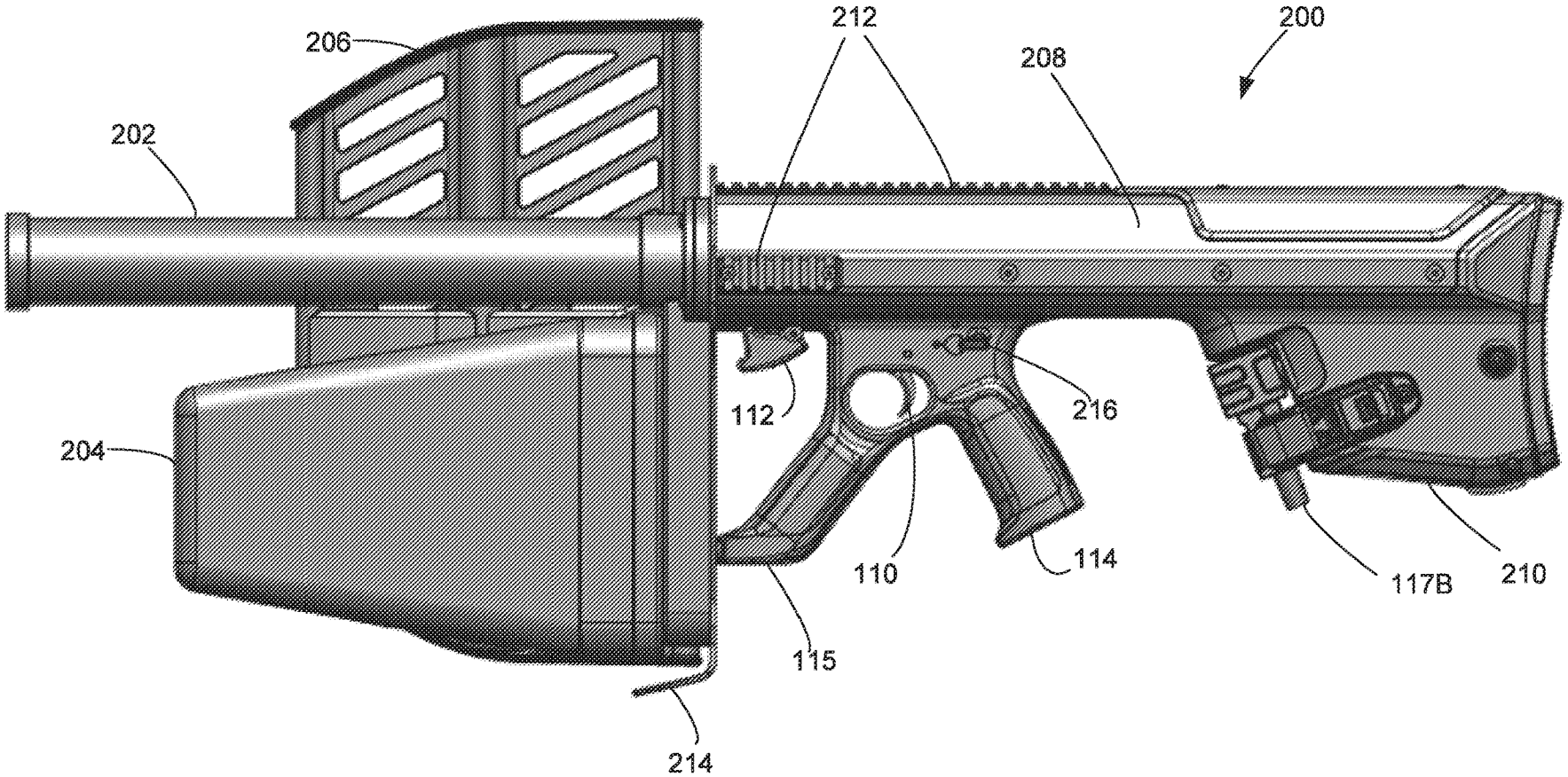
FIG. 2B illustrates a left side three-dimensional view of the example portable countermeasure device of FIG. 2A according to one embodiment of the subject application.
Figure 2C:
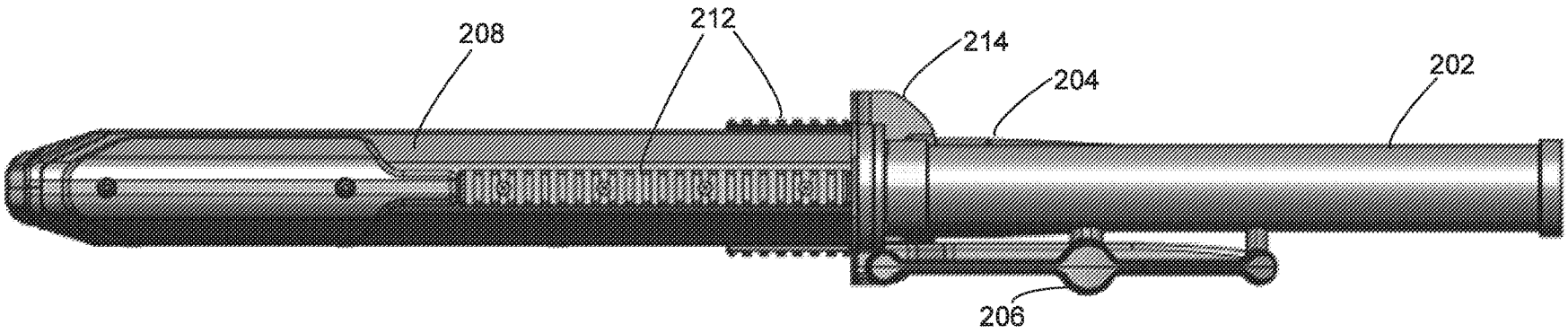
FIG. 2C illustrates a top three-dimensional view of the example portable countermeasure device of FIG. 2A according to one embodiment of the subject application.
Figure 2D:
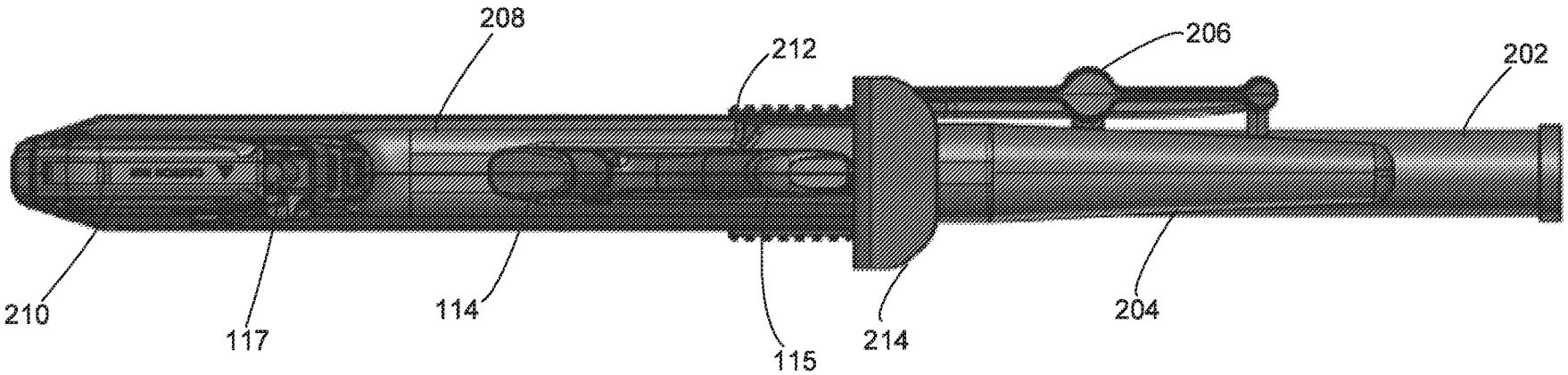
FIG. 2D illustrates a bottom three-dimensional view of the example portable countermeasure device of FIG. 2A according to one embodiment of the subject application.
Figure 2F:
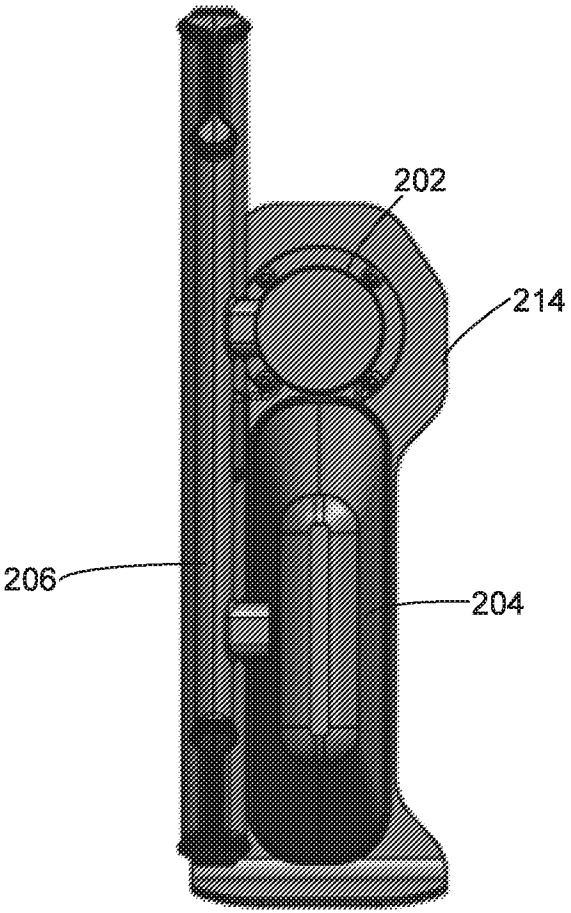
FIG. 2F illustrates a rear three-dimensional view of the example portable countermeasure device of FIG. 2A according to one embodiment of the subject application.
Figure 2E:
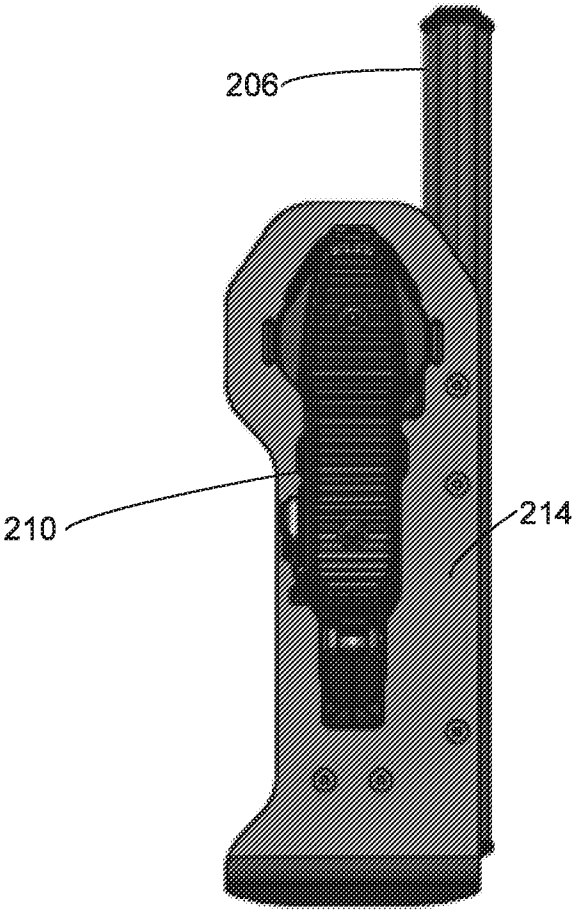
FIG. 2E illustrates a front three-dimensional view of the example portable countermeasure device of FIG. 2A according to one embodiment of the subject application.
Figure 3A:
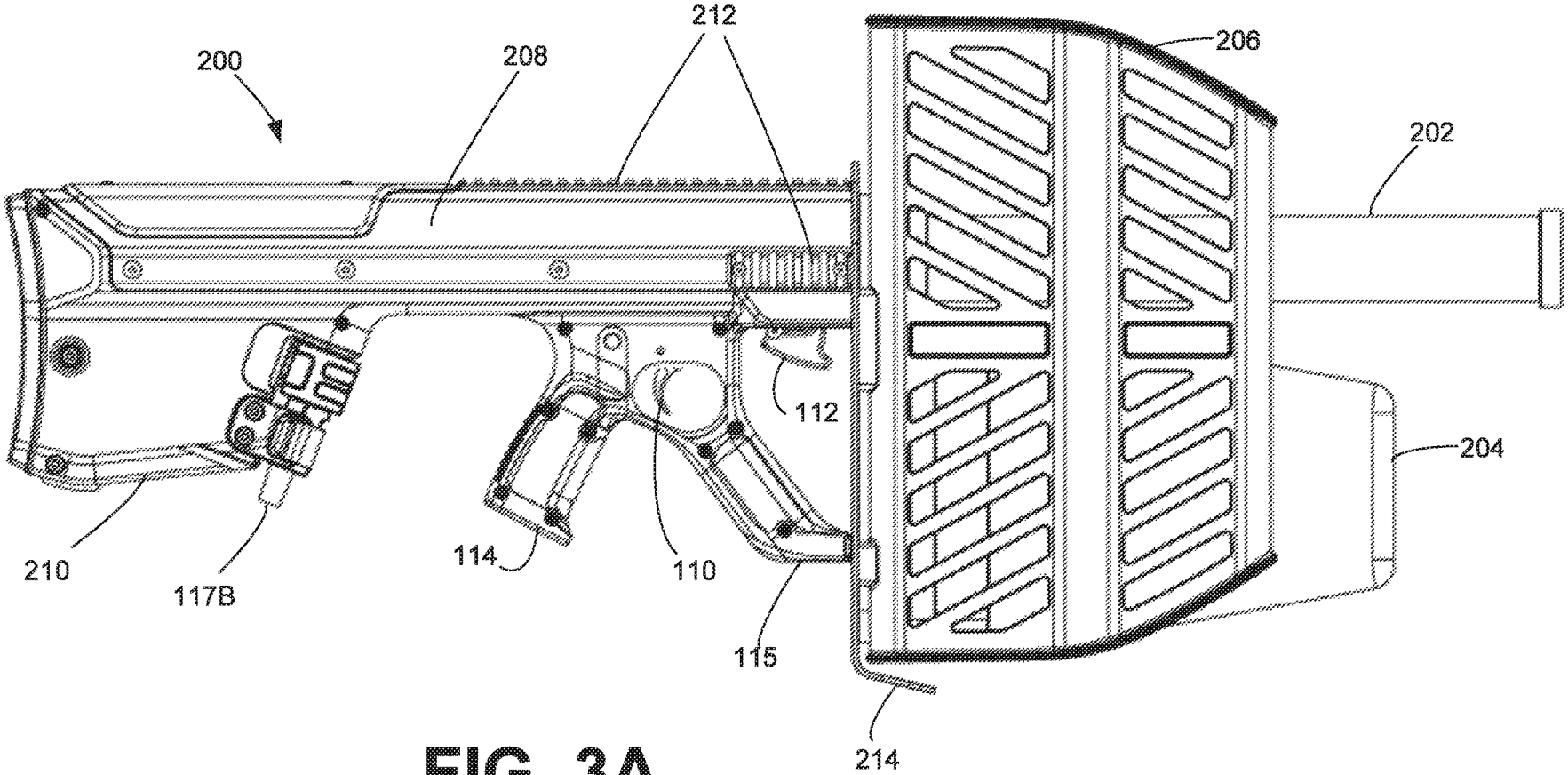
FIG. 3A illustrates a right-side view of the example portable countermeasure device of FIG. 2A according to one embodiment of the subject application.
Figure 3B:
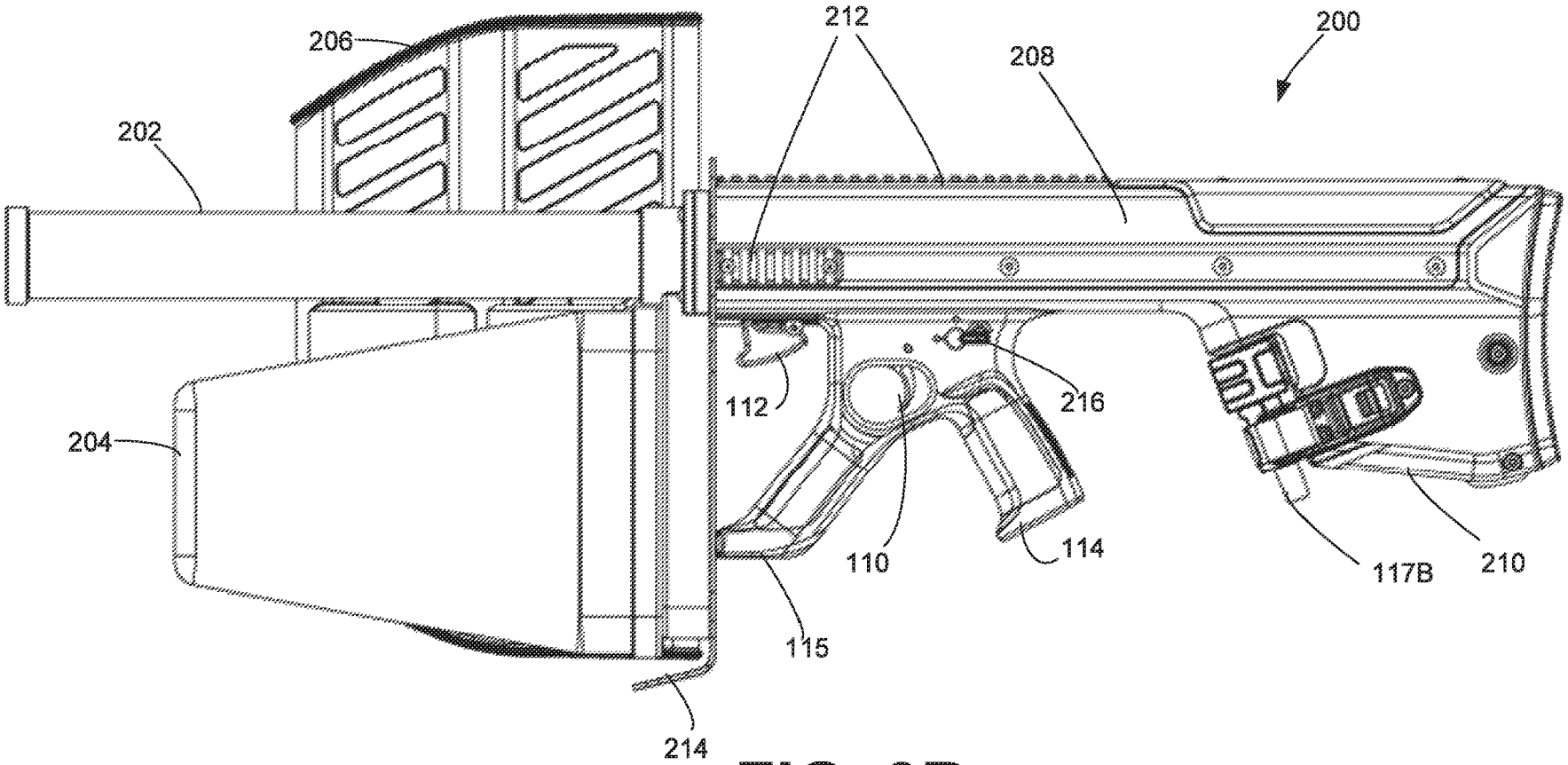
FIG. 3B illustrates a left-side view of the example portable countermeasure device of FIG. 3A according to one embodiment of the subject application.
Figure 3C:
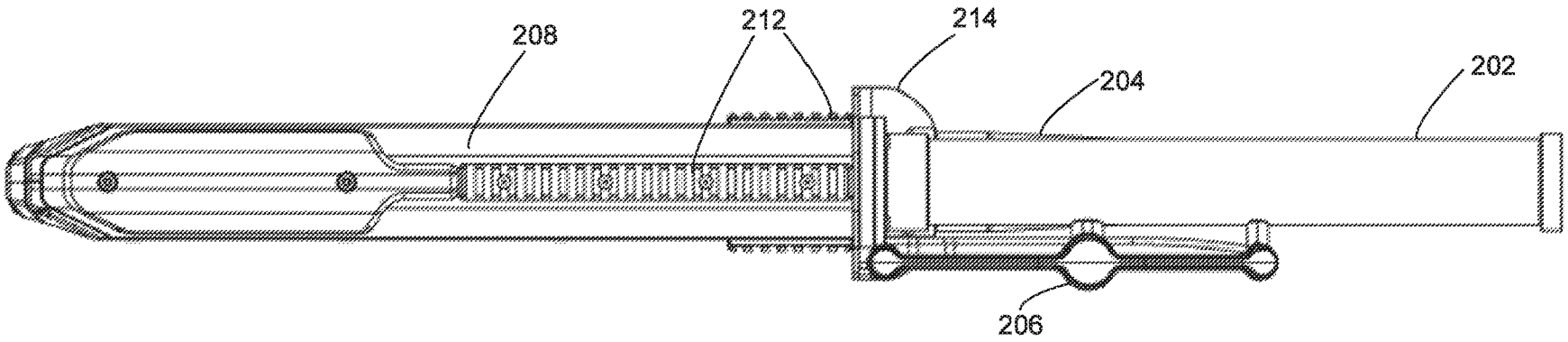
FIG. 3C illustrates a top view of the example portable countermeasure device of FIG. 3A according to one embodiment of the subject application.
Figure 3D:
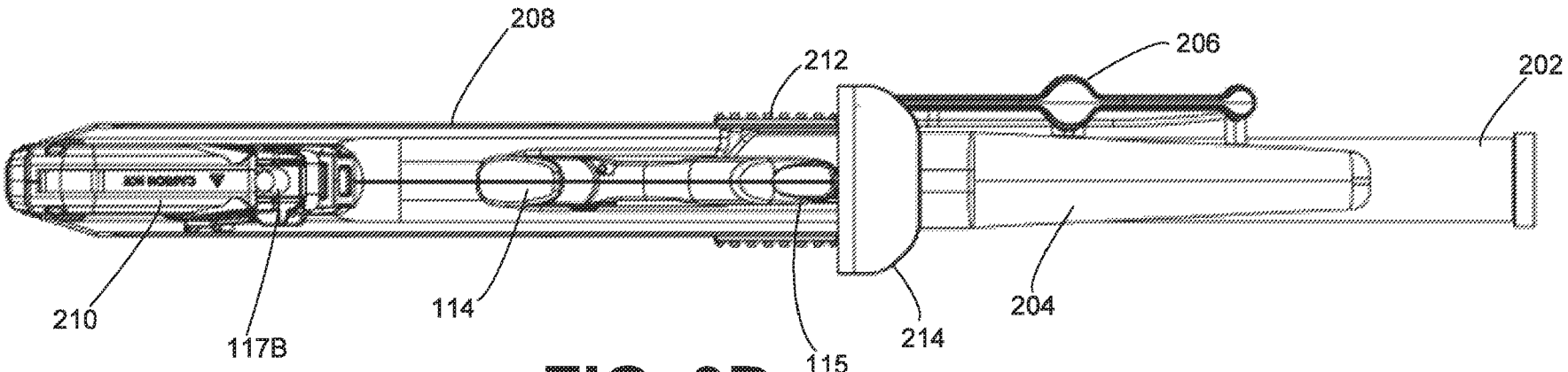
FIG. 3D illustrates a bottom view of the example portable countermeasure device of FIG. 3A according to one embodiment of the subject application.
Figure 3F:
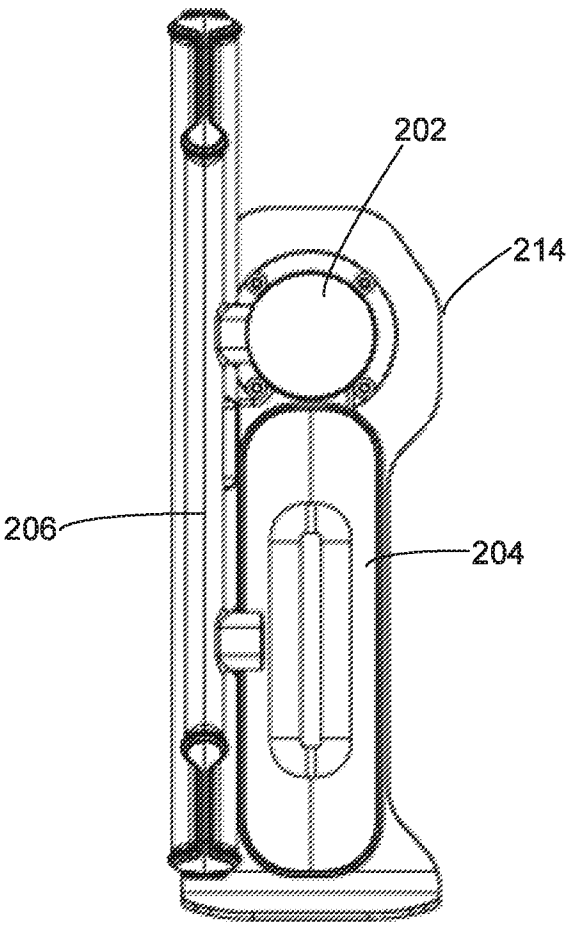
FIG. 3F illustrates a back view of the example portable countermeasure device of FIG. 3A according to one embodiment of the subject application.
Figure 3E:
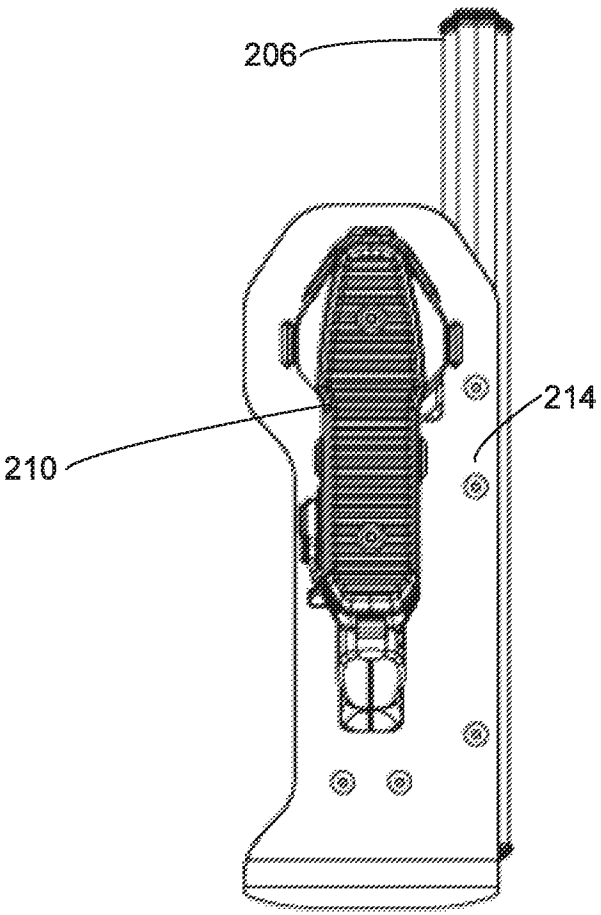
FIG. 3E illustrates a front view of the example portable countermeasure device of FIG. 3A according to one embodiment of the subject application.

The portable countermeasure device 100, as shown in FIG. 1, includes a first activator 110, located adjacent to the first grip 114. In some embodiments and as shown in FIG. 2A, a portable countermeasure device 200 may also include a second activator 112, located adjacent to the second grip 115 on underside of the body 102. It will be understood that the portable countermeasure device 100 may be implemented with a single activator, whereby multiple disruptive signals are generated via the activation of the single activator. The activator, such as activator 110 and/or 112, as will be appreciated, is operable to close a circuit or "firing mechanism" (not shown) to allow power to flow from the power source, e.g., backpack (not shown), AC power (not shown), or optional, battery pack (not shown), to the signal generator 106 and amplifier 108 of the signal disruption components 104. It will be appreciated that the activator 110 or 112 may be implemented as typical firearm triggers, toggle switches, spring-loaded buttons, or the like. According to one embodiment, the first activator 110 is operable to activate control circuitry for transmitting signals for the disruption of control frequency bands, while the second activator 112 is operable to activate control circuitry for disruption of GNSS/navigation bands. It is to be appreciated that either activator 110, 112 may active the control circuitry for transmitting any desired signal or combination of signals. Furthermore, in embodiments with a single activator, an operator of the countermeasure device 100 may, via operator input, select a desired transmitting signal. An example implementation of the dual activators 110-112 is embodied in the portable countermeasure device 200 of FIGS. 2A-3F, discussed below.

Returning to FIG. 1, in accordance with one embodiment, the signal generator 106 and corresponding amplifier 108, may be configured to generate signals from DC to 30 GHz. In another embodiment, a signal generator 106, with a corresponding amplifier 108, is configured to generate disruptive signals in the, 70-75 MHz, 400-500 MHz, 800-900 MHz, 900-1000 MHz, 1000 MHz-1.8 GHz, 2.0 GHz-2.6 GHz, 5.0-5.6 GHz frequency ranges, common cellular frequency bands, IEEE HF, VHF, UHF, L, S, C, X, $K_u$, K, $K_a$, V, W, or mm bands, or other known control/navigation signal frequency ranges. In one particular embodiment, a signal generator 106 for each of the 72 MHz frequency band, the 433 MHz frequency band, the 800 MHz frequency band, the 915 MHz frequency band, the 1.2 GHz frequency band, 1.3 GHz frequency band, the 1.5 GHz frequency band, the 2.4 GHz frequency band, and the 5.8 GHz frequency band, with corresponding amplifiers 108 are incorporated into the portable countermeasure device 100. Additionally, the signal generator 106 may be in communication with memory 103 that stores alternative command signals for spoofing or hacking, as will be known in the art, at a particular control frequency. In such embodiments, the signal generator 106 may be operable to transmit a different navigation signal (altering the coordinates the drone is receiving from navigation satellites/commands), transmit a control signal indicating the drone should land or return to home, or the like. It will be appreciated that such signals generated via the signal generator 106 may be output in addition to noise, jamming, or the like, or in place thereof.

In some embodiments, a power supply (not shown) supplies suitable power to the microprocessor board 105 and disruption components 104 of the portable countermeasure device 100. In one non-limiting example, the power supply may be implemented as a rechargeable battery, including, for example and without limitation, a lithium-ion battery, a lithium ion polymer battery, a nickel-metal hydride battery, lead-acid battery, nickel-cadmium cell battery, or other suitable, high-capacity source of power. In other embodiments, a non-rechargeable battery may be utilized, as will be appreciated by those skilled in the art. According to one exemplary embodiment, the power supply is implemented in a magazine form factor, capable of insertion into a battery well (similar to the magazine well of the lower receiver of a rifle). It will be appreciated that such an implementation will be natural to a soldier or law enforcement officer, allowing utilization of existing magazine carrying devices for carrying additional battery packs, familiarity with changing a battery pack, as well as maintain the balance of the portable countermeasure device 100 similar to those rifles with which the soldier or law enforcement officer is most familiar.

In accordance with the exemplary embodiment of FIG. 1, the portable countermeasure device 100 includes a buttstock cavity 116 within a buttstock 113. The buttstock cavity 116 is configured to receive and accept a portable, i.e. removable battery (e.g., replaceable battery 150 of FIG. 13C) to power the countermeasure device 100. The buttstock cavity 116, may be accessed by opening a hinged buttstock door 118. The buttstock door 118, at the rear end 11 of the buttstock 113 is capable of pivoting from a closed position, shown in FIG. 1, to an open position about hinge 119, illustrated and described in greater detail with respect to FIGS. 13A-C. When the buttstock door 118 is in the open position, the removable battery 150 is able to be placed within the buttstock cavity 116 and engage a suitable coupling 117A.

Closing the buttstock door 118 secures the removable battery 150 within the buttstock cavity 116 ensures proper connectivity between a battery connection and coupling 117A. In some embodiments, the closed buttstock door 118, provides a force that urges the removable battery 150 to engage connector 117A. Providing a removable/replaceable/rechargeable battery 150 within the buttstock cavity 116 may aid in weight balancing the countermeasure device 100 about the dual-grip portions 114 and 115.

In some embodiments, the portable countermeasure device 100 may utilize an auxiliary cable to a backpack power supply, a remote power source, a portable generator, fuel cell, vehicle interface, or the like. As shown in FIG. 1, a suitable coupling 117A is illustrated as positioned within the buttstock cavity 116, enabling the attachment of a replaceable battery 150 or a suitable power cable from various sources, e.g., a battery stored in a backpack, hip/fanny pack, secured to MOLLE webbing, or the like. Furthermore, the skilled artisan will appreciate that the battery pack is not limited in form and can be complementary to the form-factor of the portable countermeasure device 100, for example, similar to a rectangular magazine, tubular magazine, and the like, as well as being integrated within the body 102 of the portable countermeasure device 100, i.e., a structural battery as discussed above.

According to another embodiment, the portable countermeasure device 100 may include a display 120 operable to display remaining power levels of the battery pack, effective range of the output of the signal disruption components 104 relative to power supply level, or the like. This optional display 120 may be connected to control components such as those components present on microprocessor board 105 and be customized to display the frequency selected for output by the jammer components 104. In such an embodiment, the display 120 may be implemented as an LED, LCD, OLED, or other suitable display type. In accordance with one embodiment, the display 120 of the portable countermeasure device 100 may be implemented as a visual indicator associated with operation of the various components of the device 100. It will be appreciated that as the portable countermeasure device 100 does not provide physical recoil when operated, the display 120 provides visual feedback to the operator. As indicated above, one or more LEDs, or other suitable visual indicators, may be utilized, indicating, for example and without limitation that individual circuit cards are powered up, that individual circuit cards are within specified limits, that power is on to the operating/selected antennae, which antennae are operating, and the like.

In accordance with another embodiment, the portable countermeasure device 100 is equipped with a haptic feedback component 121, configured to provide haptic feedback through the body 102 (or grips 114, 115) to the operator when the portable countermeasure device 100 is active. In varying embodiments, the haptic feedback component 121 may be activated when one or more triggers 110, 112 are engaged and power to the signal disruption components 104 is on. In such embodiments, the haptic feedback generated by the component 121 may differ so as to indicate which antenna(e) 122A-C of FIGS. 1 and 12A-G (see also antenna (e) 202, 204, and 206 of FIG. 2A-3F) is engaged. As with other directed energy devices, e.g., lasers, RF generators, radar jammers, etc. having weapons form factors used in electronic warfare, the portable countermeasure device 100 of the subject application the does not provide any observable recoil when activated. Accordingly, the haptic feedback component 121 may provide varying feedback to triggers 110 and/or 112, grips 114 and/or 115, buttstock 113, etc., indicating activation of the portable countermeasure device 100.

In some embodiments and as shown in FIG. 1, the haptic feedback component 121 is a haptic activator placed within the grip 114. While illustrated within the grip 114, it is to be appreciated that the haptic activator may be placed in other locations, for example and without limitation, grip 115 and buttstock cavity 116. The haptic feedback component 121 may be variously embodied for example and without limitation, as an eccentric rotating mass (ERM) actuator composed of an unbalanced weight attached to a motor shaft; a linear resonant actuator (LRA), which provides feedback by moving a mass in a reciprocal manner by means of a magnetic voice coil; a piezoelectric actuator; and/or, a combination of haptic actuators.

In some embodiments, the haptic feedback component 121 is in communication with the processor 101. That is, the processor 101 may control the activity of the haptic component 121 in order to create at least one haptic feedback pattern intended to communicate information to an operator of the countermeasure device 100. For example, the processor 101 may cause the haptic feedback component 121, to vibrate continuously for a period of time. As another example of a haptic feedback pattern, the processor 101 may cause the haptic feedback component 121 to vibrate in short pulses, the short pluses may be spaced within a predetermined time. That is, the haptic feedback component 121 may provide a haptic feedback pattern of pulsing twice, pausing for a period of time (1 second), and repeating. The memory 103, may store the instructions for producing various haptic feedback patterns. It is to be understood that the example haptic feedback patterns are non-limiting and that any combination of duration of pulsing and pauses may be used.

In some embodiments, the haptic feedback component 121, generates a haptic feedback pattern associated with an operational state of the countermeasure device 100. For example, if the processor 101 detects an issue with the operation of the device 100, a haptic feedback pattern associated with a particular issue may be generated. In this way, an operator of the countermeasure device 100 is alerted to the issue and may take corrective action. For example, the processor 101 may detect that a battery of the countermeasure device is low and cause the haptic feedback component 121 to generate a haptic feedback pattern associated with low battery power (e.g., two short pluses, followed by a two second pause, repeating). The operator, recognizing the haptic feedback pattern, is alerted to the low power issue and may replace the battery on the countermeasure device 100. In some embodiments, the haptic feedback component 121 and processor 101 generate a haptic feedback pattern associated with a self-monitoring state described in greater detail below. In varying embodiments, the haptic feedback component 121 may be in communication with a selector (e.g., shown at 130 in FIG. 12A), such that the haptic feedback pattern generated corresponds to a mode of operation selected with the selector upon activation of the portable countermeasure device 100.

The portable countermeasure device 100 depicted in FIGS. 1 and 12A-G utilizes at least one directional antenna 122A-C, extending outward from the body 102 in a direction away from the operator. It will be understood that the countermeasure device 100 may utilize multiple directional antennae 122A, 122B, 122C, in accordance with the number of disruptive signals to be generated, the types of disruptive signals, desired range, and the like, as described below. It will be appreciated that, maintaining a suitable comparison to a rifle, the at least one antenna 122A-C replaces the barrel of a rifle, thereby maintaining familiarity and ease of operation by the soldier or law enforcement officer. In accordance with some embodiments, the at least one antenna 122A-C may be "hot-swappable" or "replaceable" in the field, allowing for different directional antennae to be used by the portable countermeasure device 100 in accordance with the battlefield conditions. For example, the distances involved in commercial drone disruption may utilize less power-intensive disruptive signals than military drone disruption. In such an embodiment, a suitable antenna may not need to be as large, or a different design antenna may be used. In another example, in the event that the at least one antenna 122A-C is damaged while in the field, an expedient repair capable of being performed by the soldier or law enforcement officer is replacement of the at least one antenna 122A-C, as opposed to having to submit the portable countermeasure device 100 to an armorer or electronics specialist for repair, thereby keeping the portable countermeasure device 100 operative.

In some embodiments the at least one antenna 122A-C is/are attached to a plate 123. The plate 123, may be removably attachable to the body 102 of the countermeasure device 100. That is, the single plate 123 containing at least one antenna, is able to be removed from the countermeasure device 100 and replaced with another plate, similar to plate 123, containing at least one antenna. Thus, in case an issue arisings with the transmission components the countermeasure device 100 experiences very little down time in replacement. In simple terms, the plate 123 and at least one antenna 122A-C, are plug and play components allowing for "hot swap" in the field.

In one particular embodiment, the at least antenna 122A-C is implemented as a combined, high-gain, directional antenna having a helical cross-section. Other suitable directional antenna, e.g., Yagi, cylindrical, parabolic, log periodic array, spiral, phased array, conical, patch, etc., are also capable of being utilized in accordance with the disclosure set forth herein.

Affixed to the top of the body 102, either fixed thereto, or removably attached, e.g., attachments to a rail, is at least one sight 124, allowing for aiming by the soldier or law enforcement officer of the portable countermeasure device 100 at a target drone. In other embodiments, particularly when the top of the body 102 includes the aforementioned rails, a wide or narrow field of view optical sight may be utilized to allow the soldier or law enforcement officer to target drones beyond the normal field of vision. To avoid unintentional disruption of nearby devices outside the disruption cone 126 directed by the antenna, the at least one sight 124 may be constructed of a suitable non-metallic material. The disruption cone 126 may range from 0 degrees to 180 degrees, including for example and without limitation, 0 to 120 degrees, 0 to 90 degrees, 0-45 degrees, 20 to 30 degrees or variations thereof. The effective range of the portable countermeasure device 100 may extend outward from the at least one antenna 122A-C at varying ranges, from 0 meters outward greater than or equal to 400 meters in accordance with the power supplied to the disruption components 104. Accordingly, it will be appreciated by those skilled in the art that the maximum range of the portable countermeasure device 100 may be extended or reduced in accordance with the amount of power supplied to the disruption components 104, the ratio of power to time on target, and the like.

In operation, the soldier or law enforcement officer will target a drone hovering or flying in an unauthorized area by aiming the at least one antenna 122A-C of the portable countermeasure device 100 in a manner similar to a regular firearm. That is, the soldier or law enforcement officer, using the at least one sight 124, directs the at least one antenna 122A-C of the portable countermeasure device 100 toward the drone. After ensuring that sufficient power is available, and the drone is within the effective range of the portable countermeasure device 100, the soldier or law enforcement officer activates the activator 110 to activate the control circuit (not shown), which regulates the power from a battery or other power source to the disruption components 104. In an alternative embodiment, a single activator (not shown) may control activation of all disruption components 104, thereupon simultaneously or sequentially generating disruptions signals as described herein when the activators 110 and 112 are activated. When disrupting multiple frequency bands, e.g., control signals, Wi-Fi and/or GNSS, multiple disruption signal generators 106 and amplifiers 108 are activated to produce the desired disruption signal, e.g., noise, spoofing, alternate commands, alternate coordinates, etc., on the selected frequency bands.

The disruptive signal is then directed through the at least one antenna 122A-C (capable of handling multiple frequency bands) or multiple antennae and transmitted toward the drone at which the portable countermeasure device 100 is aimed. The disruption cone 126 then extends outward from the portable countermeasure device 100 toward the drone, disrupting control and GNSS signals effectively negating the presence of the drone in the unauthorized area. Alternative embodiments disclosed herein include generating, via the signal generator 106, alternative commands to the drone, instructing the drone to land, change direction, change video broadcast stream, stop video streaming/recording, thereby overriding the original control signals. Furthermore, the portable countermeasure device 100 may be configured to transmit altered navigation coordinates, confusing the drone or forcing the drone to leave (or travel to) a particular area. The soldier or law enforcement officer then maintains his/her aim on the drone until the drone falls, retreats, loses power, or the like. The activator(s) 110-112 may then be deactivated by the law enforcement officer or soldier and the disabled drone may then be recovered by the appropriate authority for determination of the owner.

According to one example embodiment, the portable countermeasure device 100 includes hardware, software, and/or any suitable combination thereof, configured to interact with an associated operator, a networked device, networked storage, remote devices, detector systems, tracking systems, and the like. In such an example embodiment, the portable countermeasure device 100 may include a processor 101, which performs signal analysis, ballistic analysis, or the like, as well as execution of processing instructions which are stored in memory 103 connected to the processor 101 for determining appropriate signal generation for disruption, power supply management, and the like. Further, it will be understood that separate, integrated control circuitry, or the like, may be incorporated into the portable countermeasure device 100 so as to avoid interference of operations by the disruption components 104, or the like.

In some embodiments, the processor 101 is an internal microprocessor that is further configured to run internal self-monitoring operations. That is, the countermeasure device 100 includes internal components that verify that the system is operating correctly before radiating out a disruption signal to the at least one antenna 122A-C. The internal monitoring may occur at one of many points inside the RE chain (source-filtering-amplification-transmission). In some embodiments, the system verification is monitored between amplification and transmission of a signal. When the signal is monitored between amplification and transmission, a high level of confidence of performance is achieved without an external capture device.

The internal self-monitoring is achieved by tapping off a small portion of the signal after amplification. That is, the frequency or frequencies generated by the at least one signal generator 106 and amplified by the corresponding at least one amplifier 108, is measured by the processor 101 to ensure that the proper power level is in the right frequency band. Each transmitted frequency may be measured by the processor 101 simultaneously. In some embodiments, the wideband signal going to each antenna is measured to ensure there are no spurious transmissions out-of-band.

In accordance with the exemplary embodiment of FIG. 1, the countermeasure device 100 includes at least one temperature sensor 127 in communication with the processor 101 configured to measure a temperature at a desired location of the device. The at least one temperature sensor 127 may be variously embodied for example and without limitation as a thermistor, thermocouple, resistance temperature detector (RTD), and/or a combination thereof. In some embodiments, the at least one temperature sensor 127, is placed within a reading distance to the amplifier 108, such that an approximate temperature of the amplifier 108 may be measured. In other embodiments, the at least one temperature sensor 127 is placed in proximity to the replaceable battery 150, such that an approximate temperature of the battery 150 may be measured.

In some embodiments, the processor 101 is configured to receive a temperature from the at least one temperature sensor 127. If the received temperature is above a predetermined threshold temperature, the processor 101 may selectively remove power to the high temperature amplifier 108 or may power down the countermeasure device 100 entirely. In some embodiments, upon detection of a temperature greater than a predetermined threshold temperature, the processor 101 generates a haptic feedback pattern communicated by the haptic feedback component 121 and processor 101, to inform the operator of the temperature issue. In some embodiments, the processor 101, is configured to both send haptic feedback as described as well as remove power from the hot detected amplifier. In some embodiments, the processor 101 is further configured to record the measured temperatures of the countermeasure device 100 and store the temperature information in a data log described in greater detail below.

In some embodiments, the countermeasure device 100 includes a GNSS receiver 128 in communication with the processor 101 to monitor the geographic position of the device 100 and provide, change, or unlock features associated with a determined position. For example and without limitation, a geolocation of the countermeasure device 100 may be detected and the processor 101, memory 103, and associated software may load a particular device profile set for that particular geolocation. A particular device profile may include instructions executed by the processor 101 for the countermeasure device 100 to radiate a disruption signal at a particular power and/or at a predetermined frequency band. In this way, the countermeasure device 100 may automatically select a device profile associated with a particular power and frequency band based on a profile tied to a geolocation. In some embodiments, the processor 101 determining the geolocation of the device, may communicate to the operator via the haptic feedback component 121, when the operator holding the countermeasure device 100, enters or leaves a geographic location. For example, haptic feedback may be provided to the operator upon entering or leaving defined enemy territory, restricted areas, or areas defined by geofencing. In some embodiments, the processor 101 is further configured to record the measured geolocation of the countermeasure device 100 and store the geolocation information in a data log described in greater detail below.

In some embodiments, the countermeasure device 100 includes a time module that counts the operational time of the countermeasure device 100. The operational time may be stored and updated into the system memory 103 for example and without limitation, diagnostic and maintenance purposes. As an illustrative example, if a time count reaches a certain threshold (e.g., 10 hours), the countermeasure device 100 may communicate to the operator (via display 120 and/or haptic feedback 121) that a maintenance is set to be performed. In some embodiments, the processor 101 is further configured to record the measured time counts of the countermeasure device 100 and store the time information in a data log described in greater detail below.

In some embodiments, the internal self-monitoring is performed continuously while radiating and reported back to the operator (e.g., via haptic feedback 121). The data created during the internal self-monitoring may be logged and stored in the memory 103 for system performance analysis at a later time.

In some embodiments, the countermeasure device 100 includes internal components configured to log system performance. In accordance with such embodiments, the system performance information may correspond to machine state logs, which provide a capture of the state of the countermeasure device 100 at a particular point in time. For example, and without limitation, the machine state log may include the position of a trigger (e.g., activated/inactive), power level, internal switch position, length of trigger activation, selector switch position, and the like. It will be appreciated that other commonly recorded system operation information may be included herein, such as the configuration of the countermeasure device 100, e.g., settings, power levels, switch positions, temperatures, etc., and the preceding listings are intended as nonlimiting examples thereof. The system performance information may be recorded to the internal memory 103 or to a portable memory (e.g., a micro-SD card). That is, the microprocessor board 105, includes a receptacle (e.g., a memory card slot) configured to accept and read a portable memory inserted therein. In some embodiments, the memory card slot is located on the edge of the microprocessor board 105 closest to the antennas. In other embodiments, the memory card slot is located in the buttstock cavity 116 and accessible when opening the buttstock door 118. In other embodiments, the memory card slot is located within the body 102, requiring removal of a portion of the body for access. It is to be appreciated that the exemplary locations are for example purposes only and are not to be considered limiting.

According to another example embodiment, the portable countermeasure device 100 may include a selector control (130 of FIG. 12A), which may be located on the exterior of the portable countermeasure device 100 and easily accessible by the operator. Such a selector control may be operable to select a frequency or frequencies to be generated by the at least one signal generator and amplified by the corresponding at least one amplifier 108. In accordance with one alternate embodiment, a variable amplifier may be used, whereupon power supplied to the signal generators 106 is modified, without increasing the power drain of the portable countermeasure device 100. It will be appreciated that the selector control may be implemented to provide ease of use to the soldier or law enforcement official in the field to reflect the desired target of the portable countermeasure device 100.

In some embodiments, the portable counter measure device 100 includes a variable output attenuation feature. That is, the processor 101 controls the total outpower power of the countermeasure device 100. The total output 103 power may be implemented by software instructions stored in the memory and executed by the processor 101, or by hardware with an integrated processor or in communication with processor 101. In some embodiments, the power is attenuated by Pulse-Width Modulation (PWM) or Pulse-Duration Modulation. In other embodiments, attenuation is achieved by voltage control of the at least one amplifier 108. In yet still other embodiments, attenuation is achieved by source waveform control. In still further embodiments, attenuation is achieved via a variable voltage attenuator. Attenuating the signal reduces the effective range of the countermeasure device 100. In some embodiments, the selector control 130 is in communication with the processor 101. The selector control 130 may be manipulated by the operator to attenuate the output signal, e.g., via PWM.

Turning now to FIGS. 2A-3F, therein are illustrated three-dimensional and line views of an example portable countermeasure device 200 utilizing a multi-antenna (202, 204, and 206) implementation of according to one embodiment of the subject disclosure. As shown in FIGS. 2A-3F, the portable countermeasure device 200 instead of utilizing an existing firearm, utilizes a suitable dual-grip firearm-like form factor body 208 to which the various components are attached, e.g., custom rifle stock. The dual-grip form factor body 208 includes an attachment rail 212 for affixing optics, e.g., red dot sights, iron sights, holographic sights, or the like, as well as additional components. Suitable rails 212, include, for example and without limitation, Picatinny, Weaver, NATO accessory rail, KeyMod, M-LOK, and the like. In this embodiment, the disruption components (not shown) are inserted within the dual-grip, firearm-like, form factor body 208 in place of the standard firearm components, e.g., the receiver(s) and barrel. This reduces the cost of implementation of the subject disclosure, while preserving the familiarity with a common weapon for the soldier and/or law enforcement personnel.

Figure 6A:
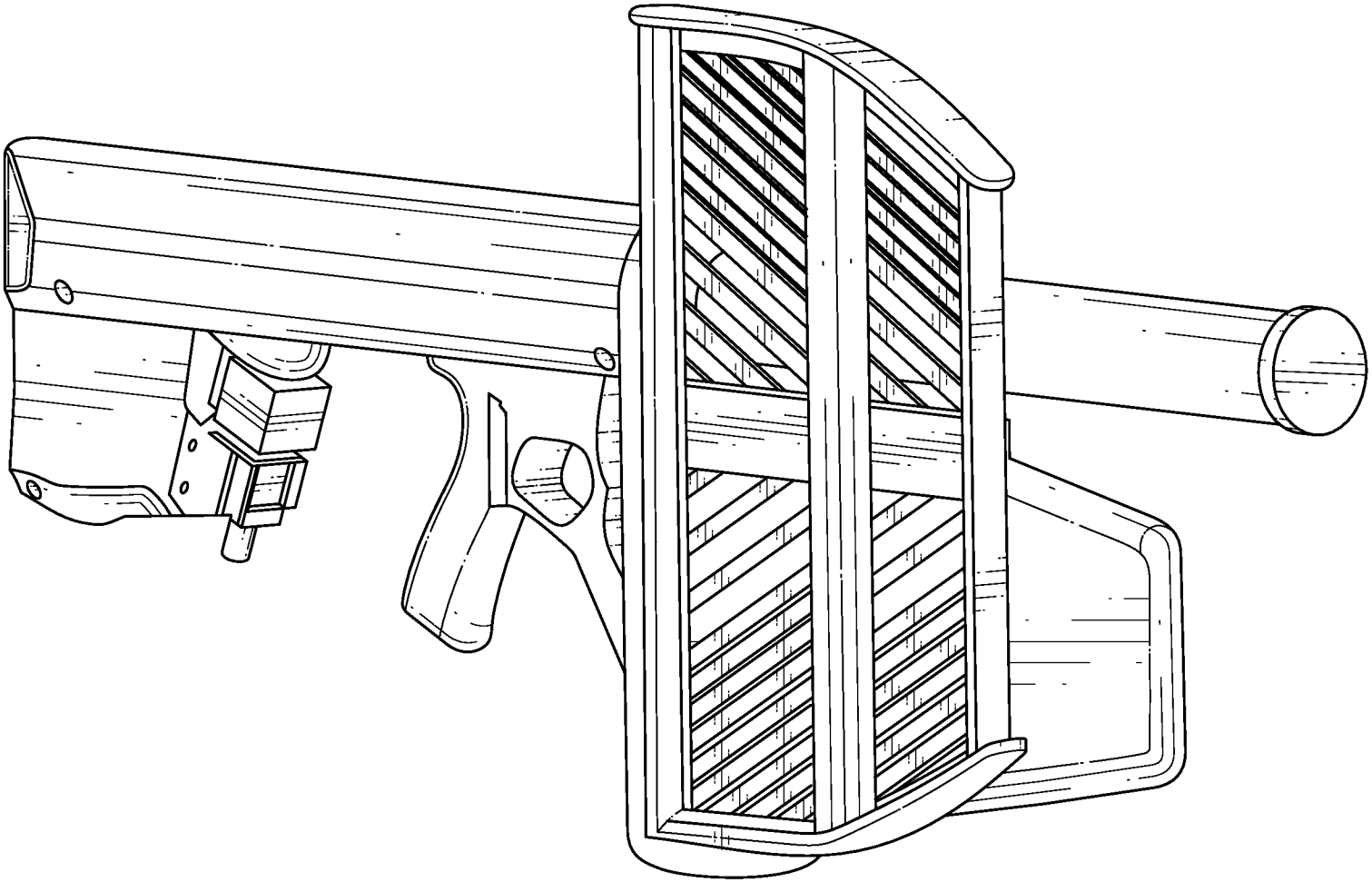
FIG. 6A illustrates a three-dimensional rendering of the portable countermeasure device of FIGS. 2A-3F in accordance with one aspect of the exemplary embodiment.
Figure 6B:
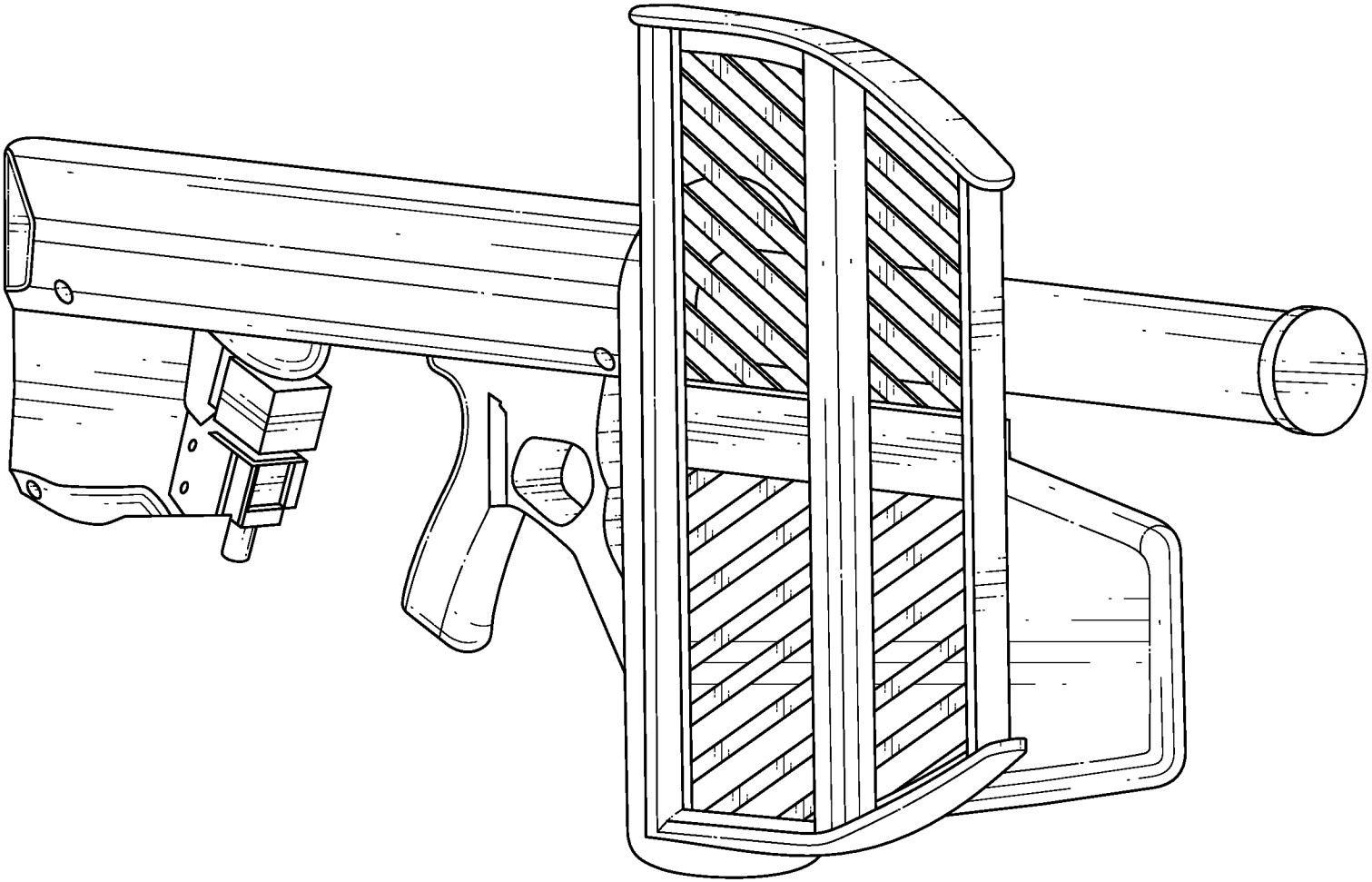
FIG. 6B illustrates a three-dimensional rendering of an alternate embodiment of the portable countermeasure device of FIGS. 2A-3F in accordance with one aspect disclosed herein.
Figure 6C:
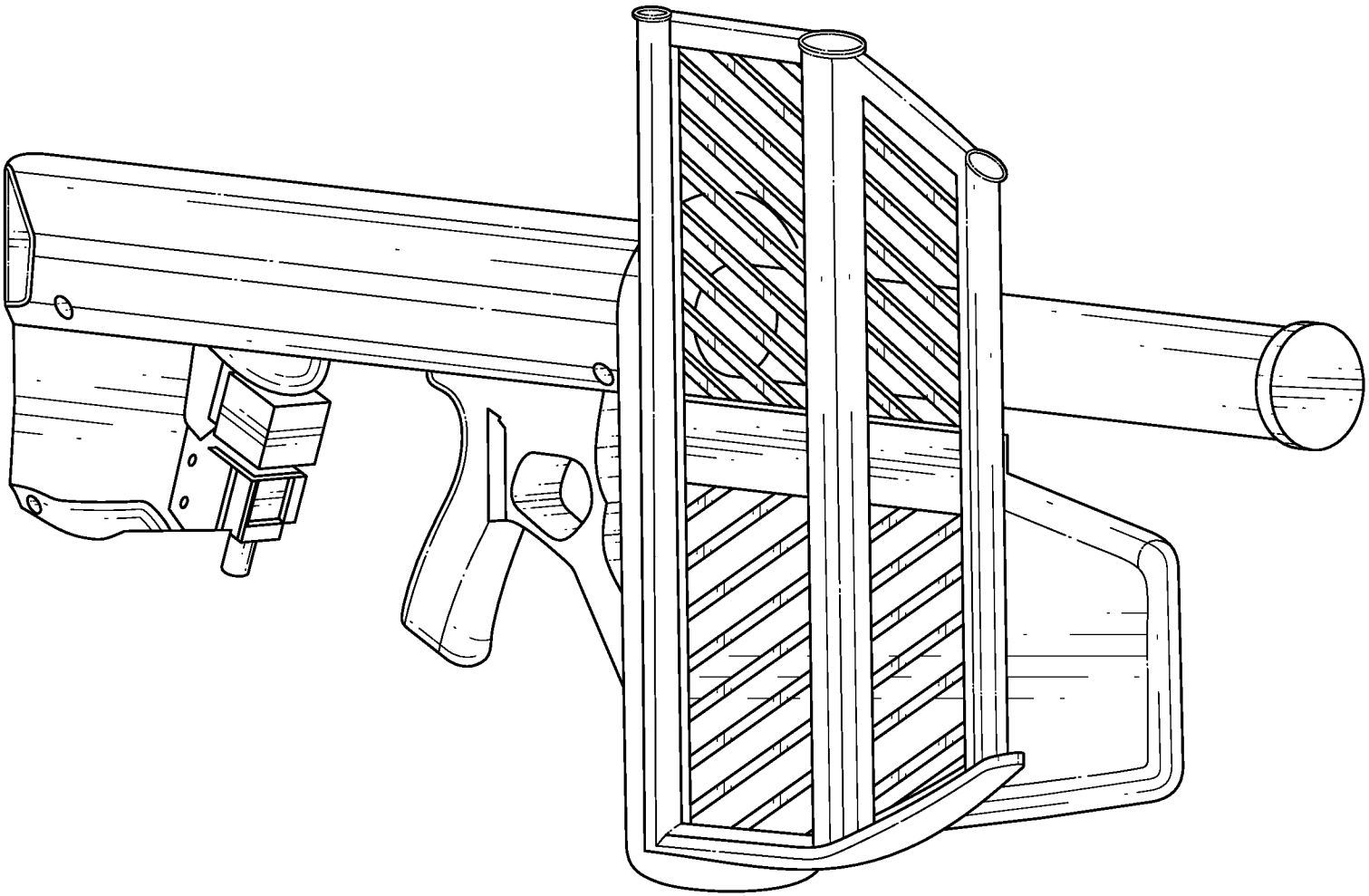
FIG. 6C illustrates a three-dimensional rendering of another alternate embodiment of the portable countermeasure device of FIGS. 2A-3F in accordance with one aspect disclosed herein.
Figure 7A:
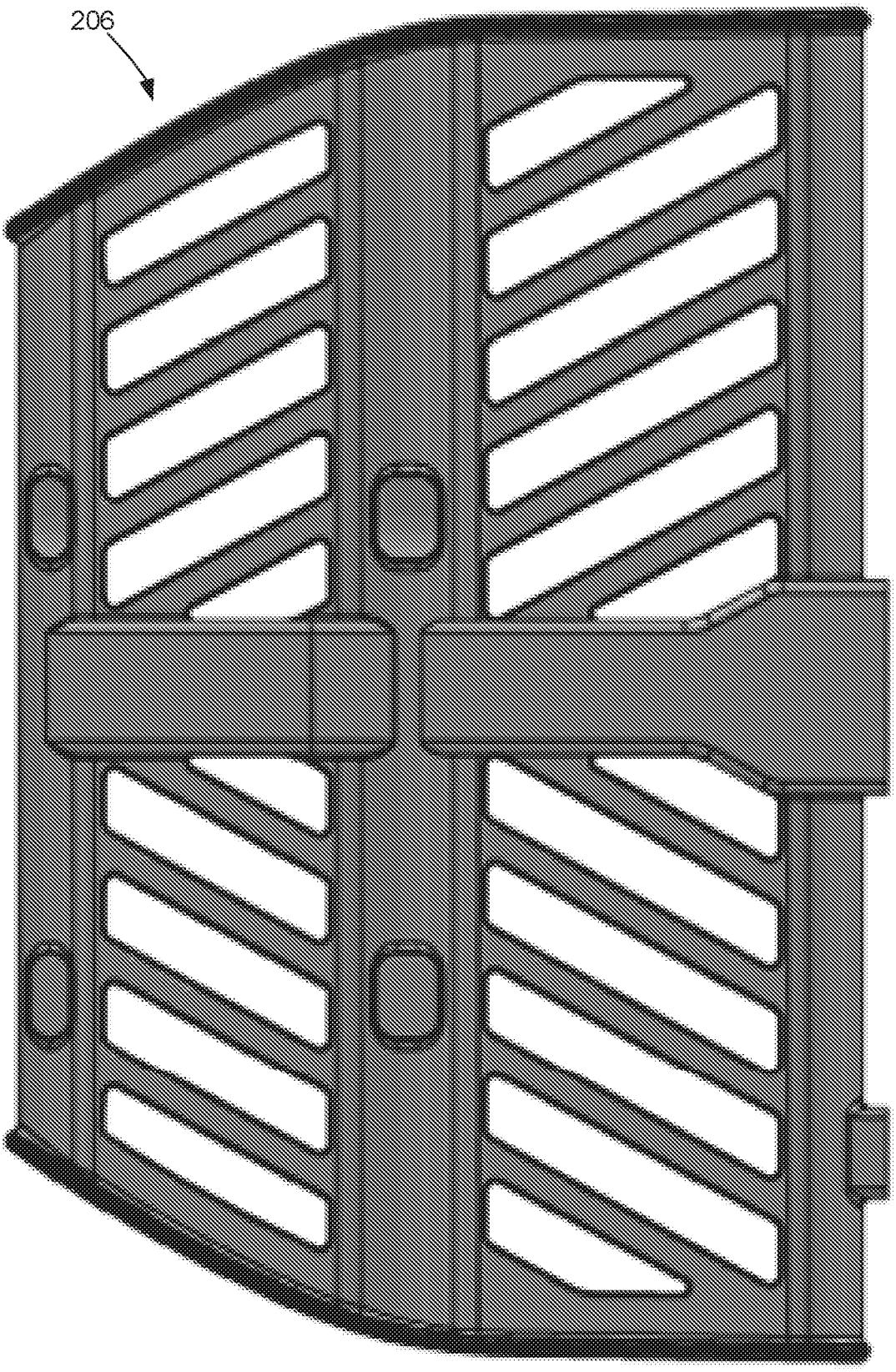
FIG. 7A illustrates a three-dimensional side view of a yagi antenna utilized by the portable countermeasure device of FIGS. 2A-3F in accordance with one embodiment.
Figure 7B:
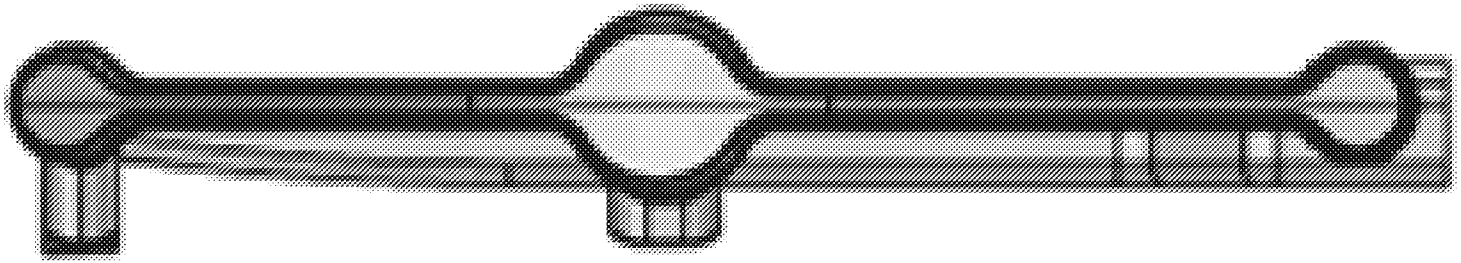
FIG. 7B illustrates a three-dimensional top view of the yagi antenna utilized by the portable countermeasure device of FIG. 7A in accordance with one embodiment.
Figure 7C:
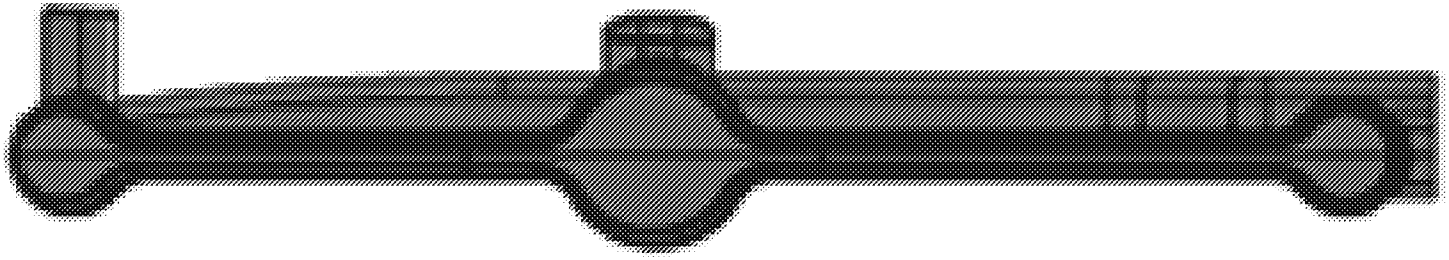
FIG. 7C illustrates a three-dimensional bottom view of the yagi antenna utilized by the portable countermeasure device of FIG. 7A in accordance with one embodiment.
Figure 7D:
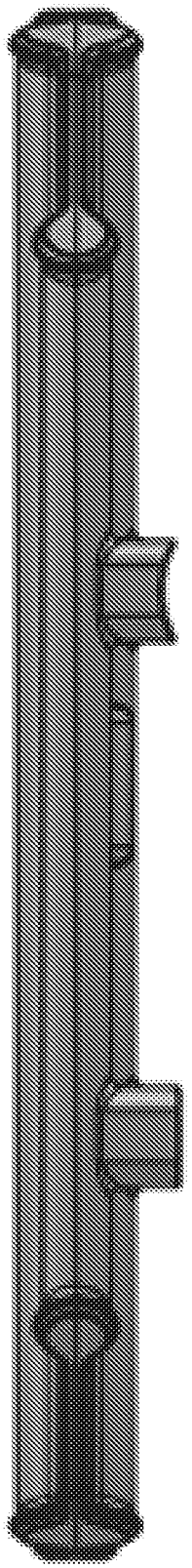
FIG. 7D illustrates a three-dimensional front view of the yagi antenna utilized by the portable countermeasure device of FIG. 7A in accordance with one embodiment.
Figure 7E:
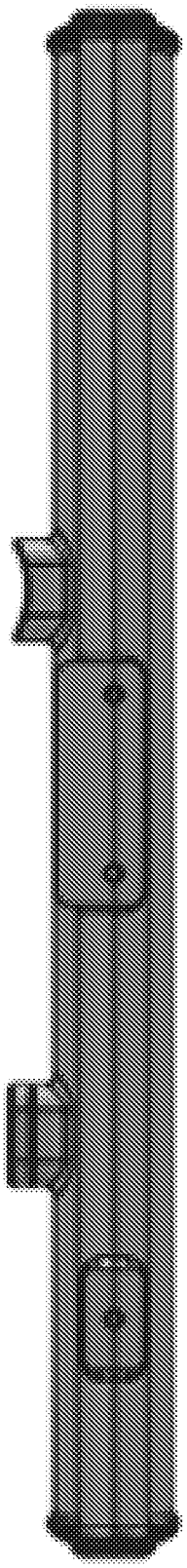
FIG. 7E illustrates a three-dimensional rear view of the yagi antenna utilized by the portable countermeasure device of FIG. 7A in accordance with one embodiment.
Figure 8A:
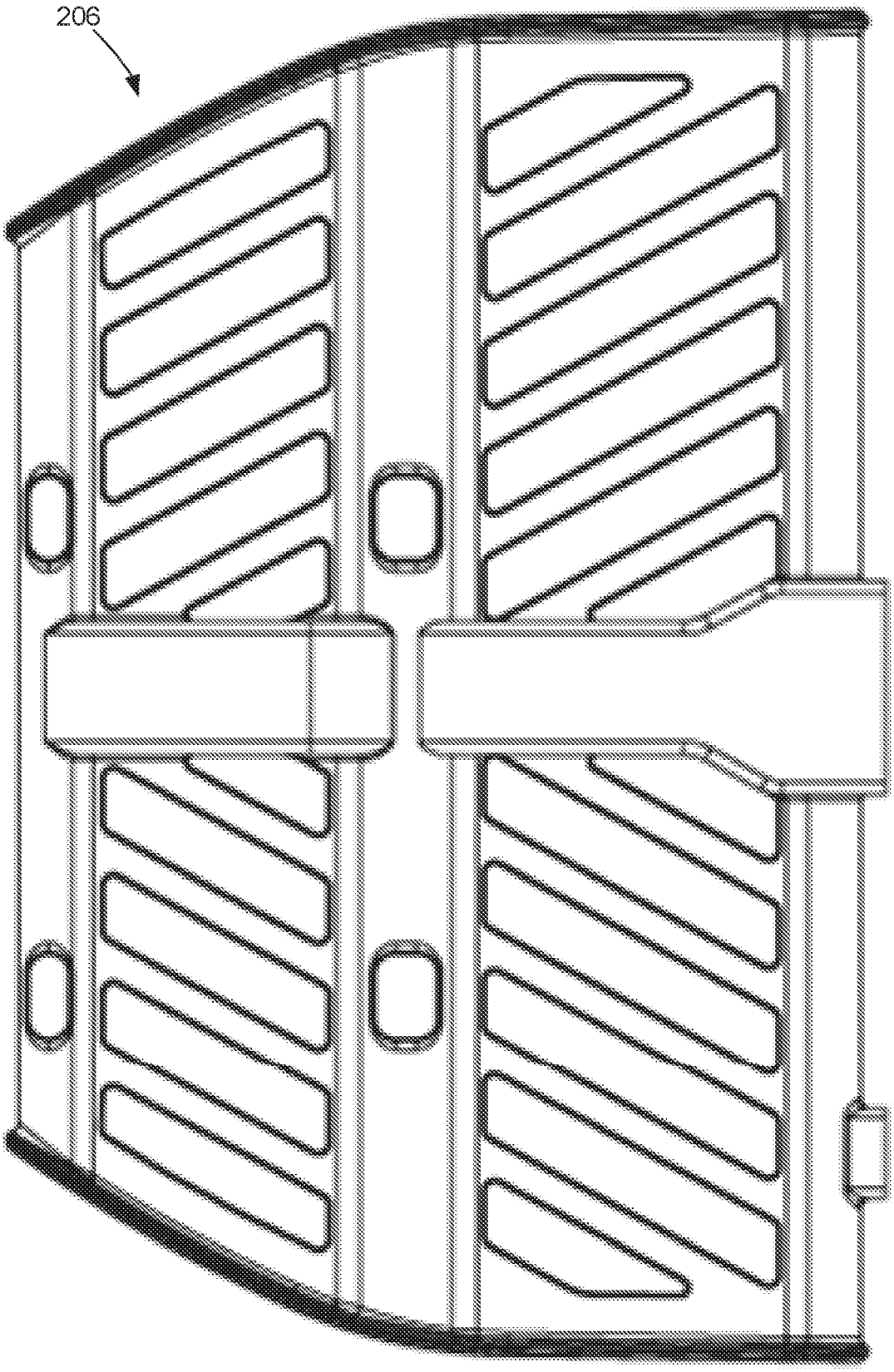
FIG. 8A illustrates a side view of the yagi antenna depicted in FIG. 7A utilized by the portable countermeasure device in accordance with one embodiment.
Figure 8B:
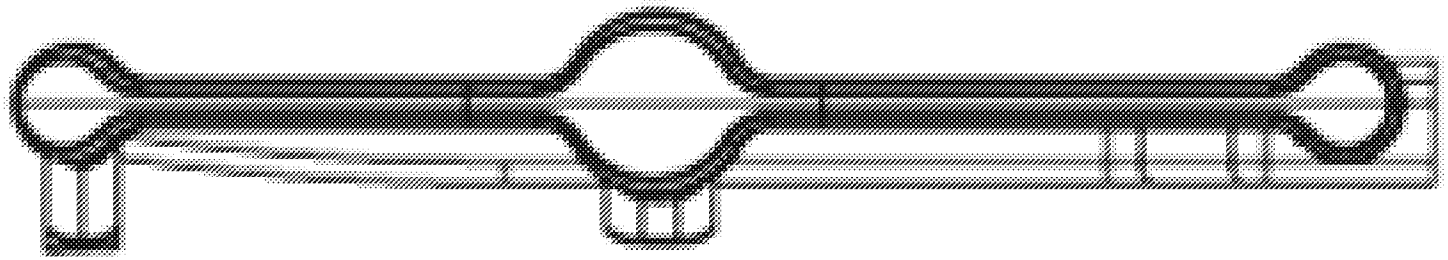
FIG. 8B illustrates a top view of the yagi antenna depicted in FIG. 7A utilized by the portable countermeasure device in accordance with one embodiment.
Figure 8C:
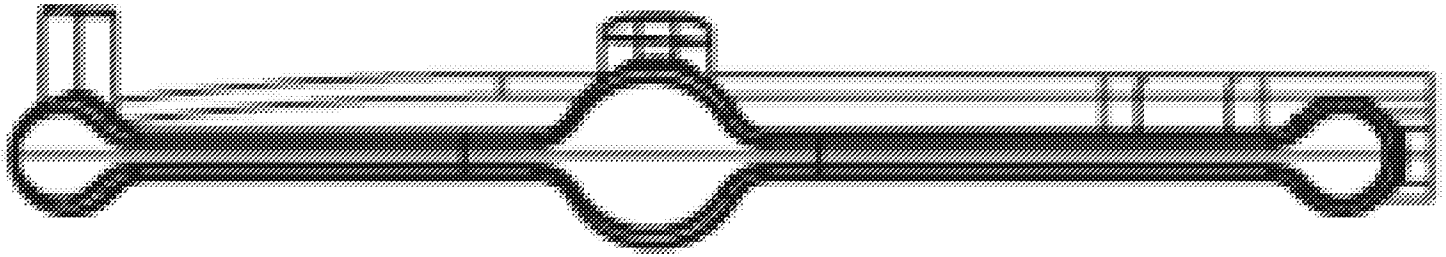
FIG. 8C illustrates a bottom view of the yagi antenna depicted in FIG. 7A utilized by the portable countermeasure device in accordance with one embodiment.
Figure 8D:
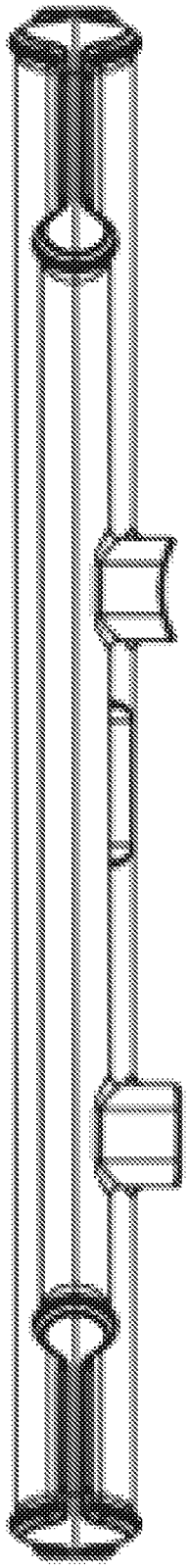
FIG. 8D illustrates a front view of the yagi antenna depicted in FIG. 7A utilized by the portable countermeasure device in accordance with one embodiment.
Figure 8E:
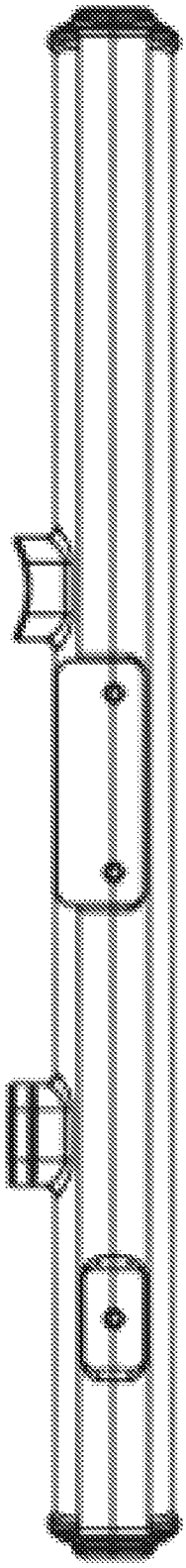
FIG. 8E illustrates a rear view of the yagi antenna depicted in FIG. 7A utilized by the portable countermeasure device in accordance with one embodiment.

The multiple antennae 202, 204, and 206 illustrated in FIGS. 2A-3F, are coupled to the body 208 adjacent a reflector 214, which directs signals away from the operator and toward the target. The antennae 202, 204, and 206 may correspond, for example and without limitation, to a Yagi antenna, a proprietary double helical antenna, an LPA, and/or various combinations thereof, depending upon the frequencies being targeted by the portable countermeasure device 200. The body 206 further includes a buttstock section 210 incorporating a connector 117B, as discussed supra. In addition to the foregoing, the body 208 of the portable countermeasure device 200 illustrated in FIGS. 2A-3F utilizes the above-mentioned dual-grips 114 and 115. It will be appreciated that the configuration of the first grip 114 angled toward the buttstock 210 and the second grip 115 angled toward the antennae 202, 204, and 206 allow the operator to easily control and aim the device 200 towards an intended target. As shown, the second grip 115 extends downward from the trigger guard of the first trigger 110 and allows an operator easy access to the second trigger 112, without requiring the operator to adjust his/her grip on the device 200. Also depicted in FIGS. 2A-3F is a selector switch 216, optionally included to allow for the operator to select which frequency or frequencies to be jammed by the portable countermeasure device 200. That is, according to one embodiment, the selector 216 is communicatively coupled to the internal disruptor components 104 of the portable countermeasure device 200, allowing the operator to enable jamming of one or more frequencies. FIGS. 6A, 6B, and 6C provide three-dimensional depictions illustrating varying embodiments of the portable countermeasure device 200, including the aforementioned dual-grips 114 and 115.

As illustrated in FIGS. 6A-6C, the portable countermeasure device 200 may utilize varying embodiments of the antenna 206, as shown therein. In particular, the antenna 206 is representative of a Yagi antenna, suitably configured, in one embodiment, to transmit signals in the 400-500 MHz range, with particular emphasis on the 433 MHz frequency. The antenna 206, as shown in FIGS. 6A-6C is capable of implementation using a variety of shields, protecting the antenna from damage during transport and use. A more detailed illustration of one embodiment of the antenna 206 is shown in the three-dimensional views of FIGS. 7A-7E, and the line drawings of FIGS. 8A-8E.

Figure 4:
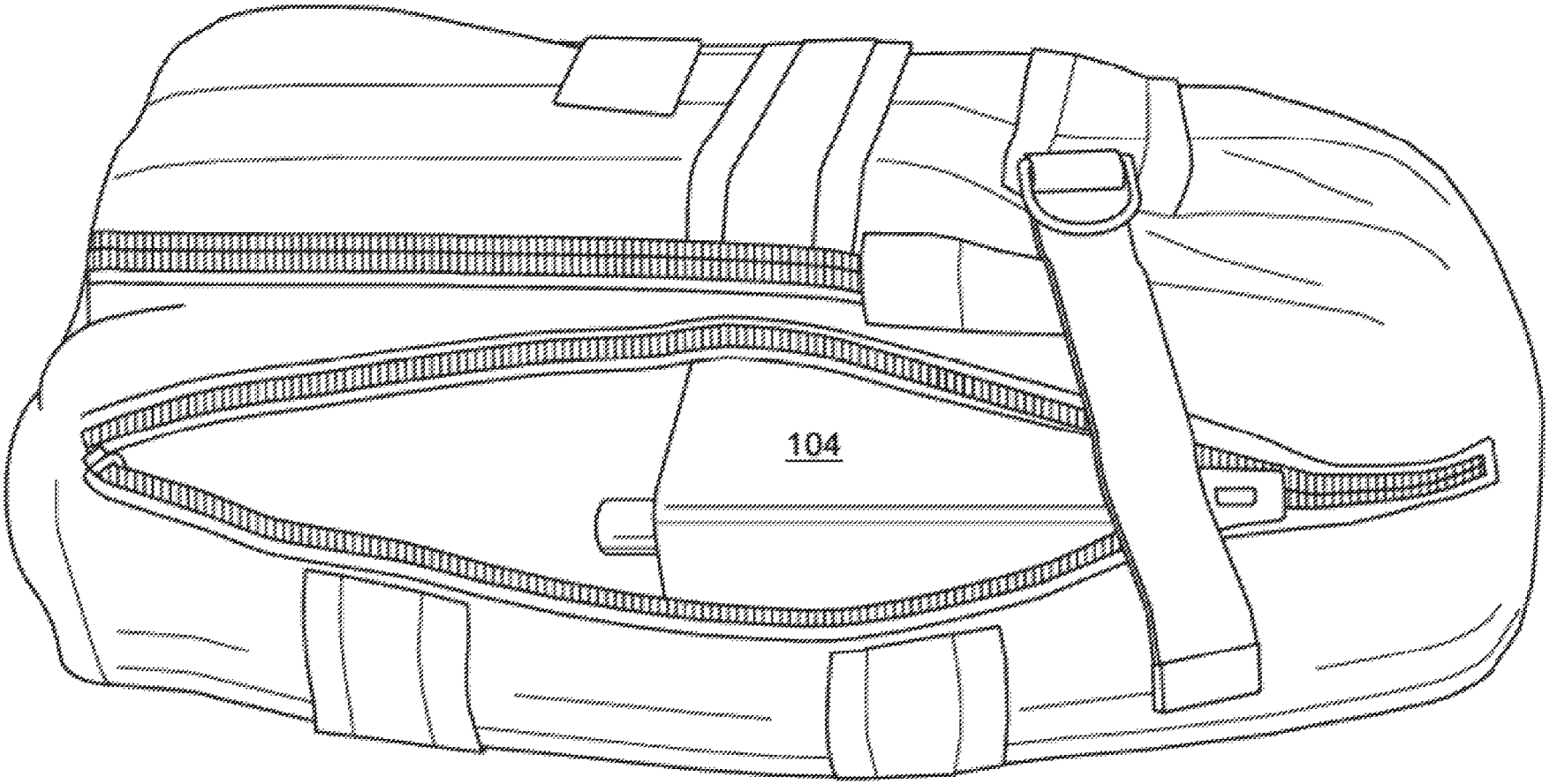
FIG. 4 illustrates an external backpack containing the jammer components utilized by the example portable countermeasure device of FIG. 2.
Figure 5:
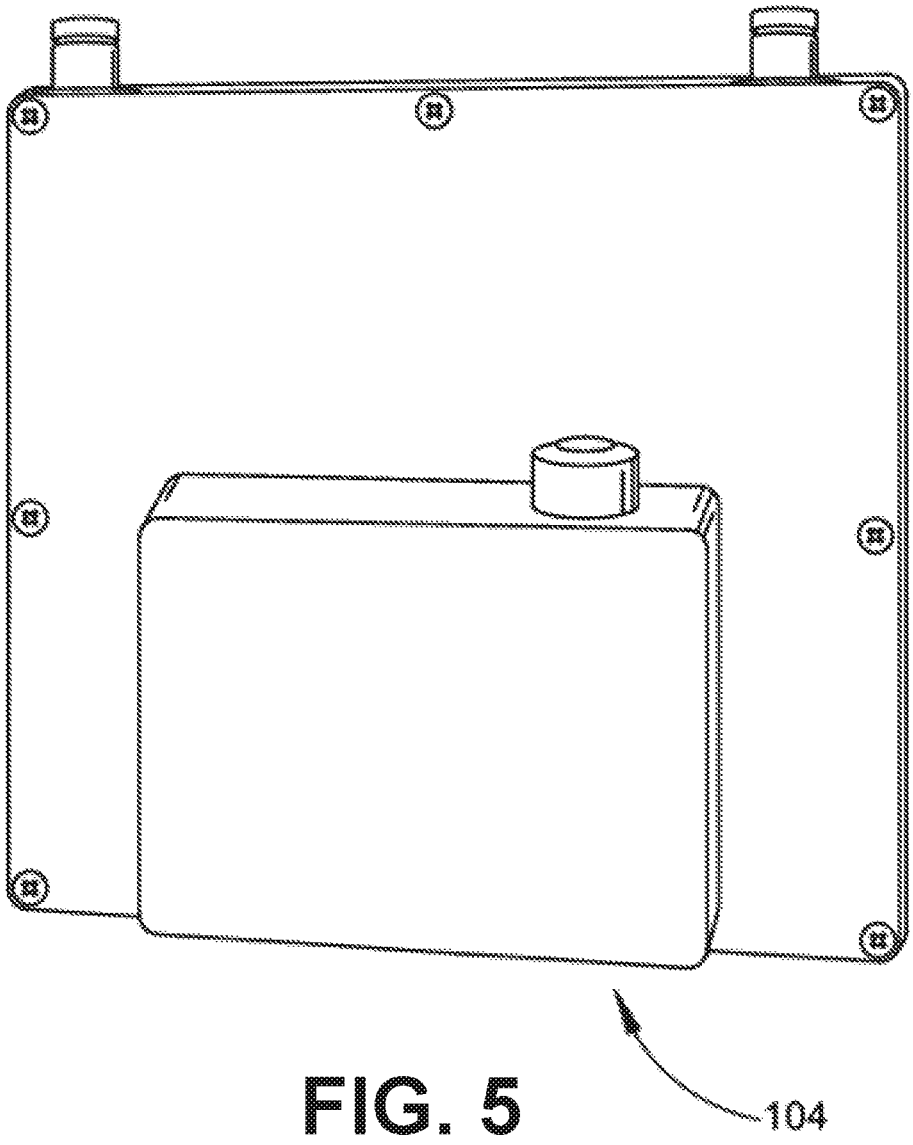
FIG. 5 illustrates a close up view of jammer components utilized by the portable countermeasure device of the example embodiment of FIG. 2.

It will be appreciated that the embodiment of FIGS. 2A-3F, and FIGS. 6A-6C utilizes disruption components 104 located within the body 208 of the portable countermeasure device 200. However, in an alternate embodiment, as depicted in FIGS. 4 and 5, the disruption components 104 may be removably coupled via connector 117B to the portable countermeasure device 200 externally, as shown.

Figure 9A:
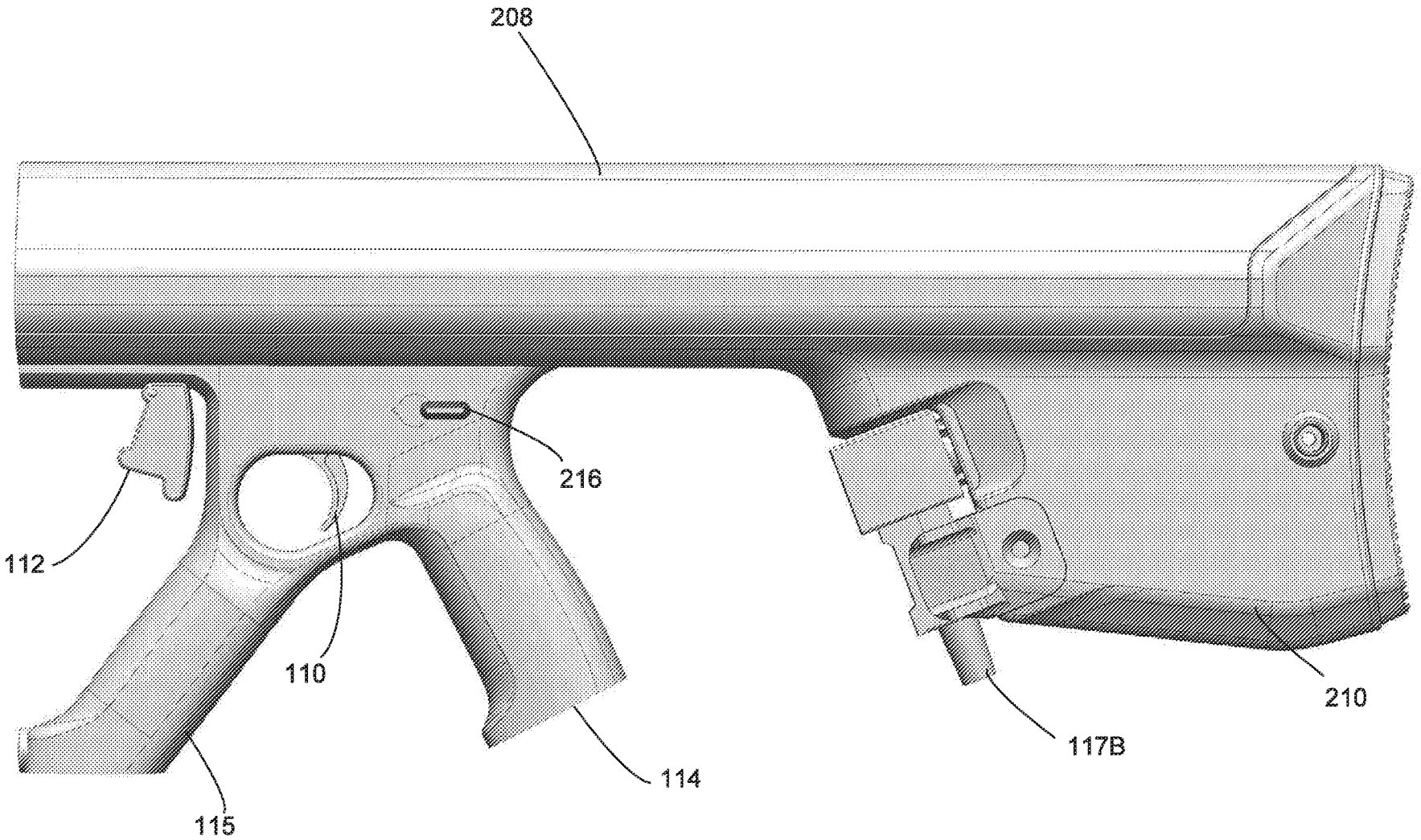
FIG. 9A illustrates a close-up view of the dual-grip configuration of the portable countermeasure device of FIGS. 2A-3F in accordance with one aspect of the exemplary embodiment.
Figure 9B:
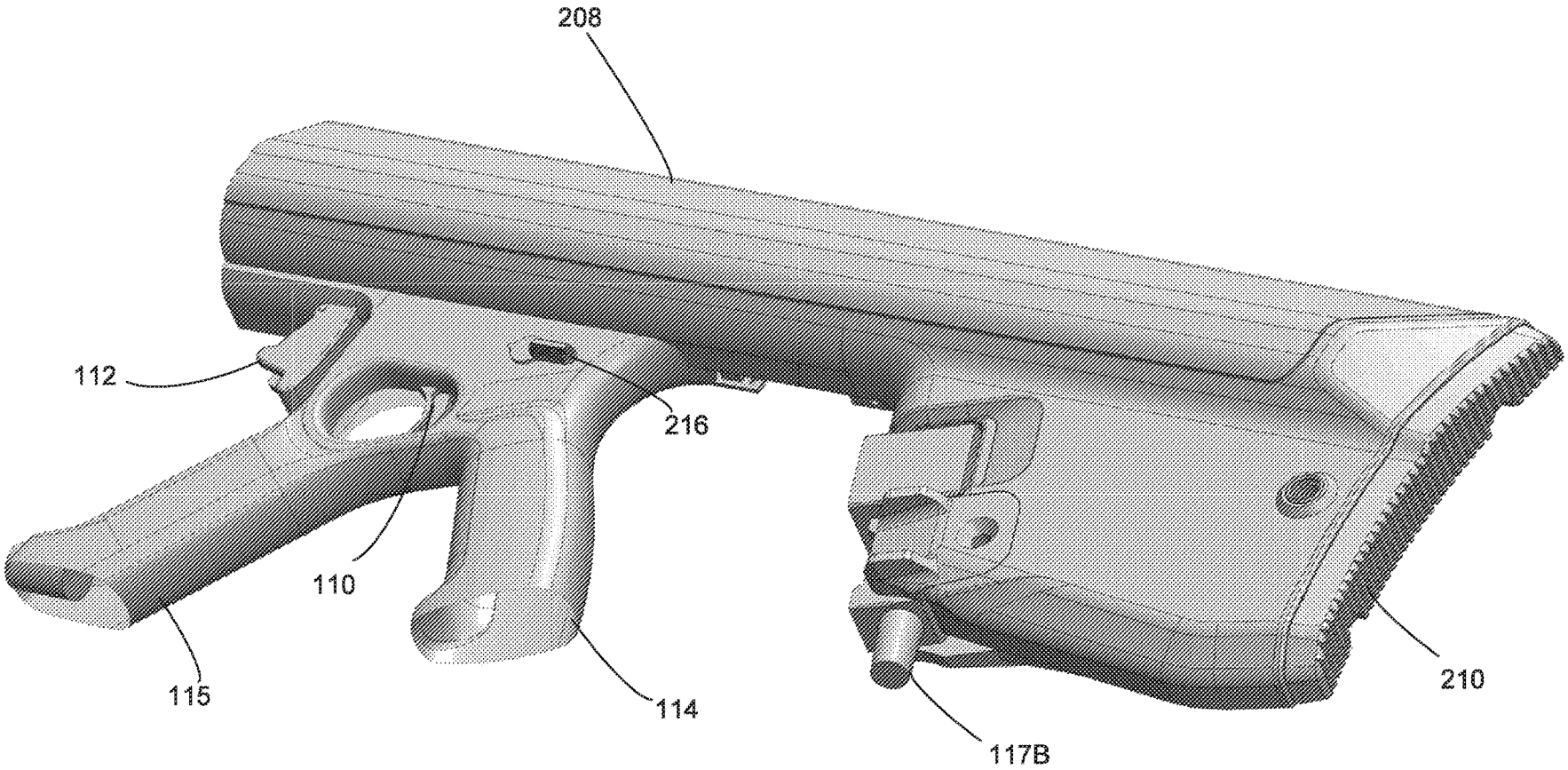
FIG. 9B illustrates another close-up view of the dual-grip configuration of the portable countermeasure device of FIGS. 2A-3F in accordance with one aspect of the exemplary embodiment.
Figure 10A:
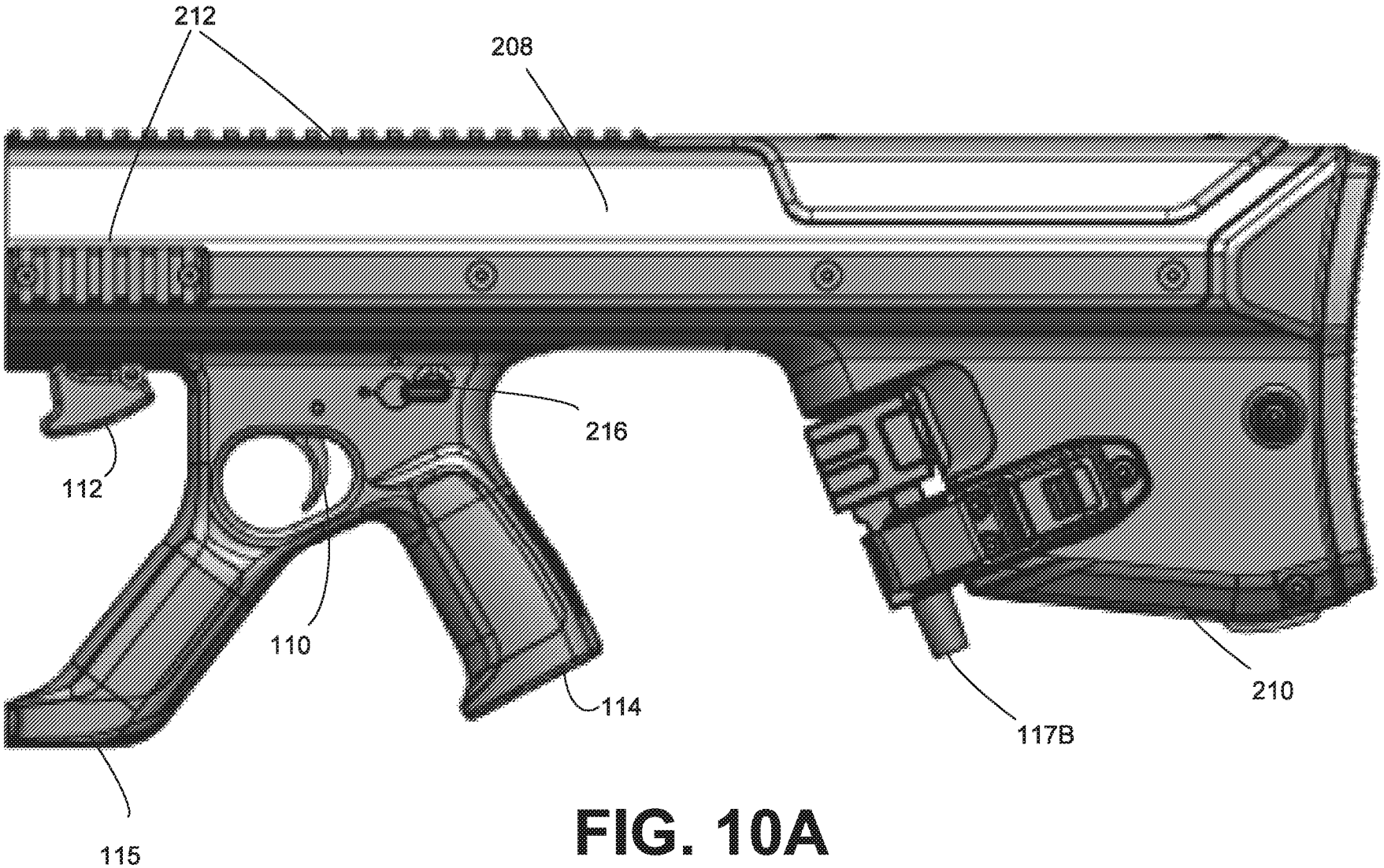
FIG. 10A illustrates a three-dimensional left side view of the dual-grip configuration of the portable countermeasure device of FIGS. 9A-9B in accordance with one embodiment of the subject application.
Figure 10B:
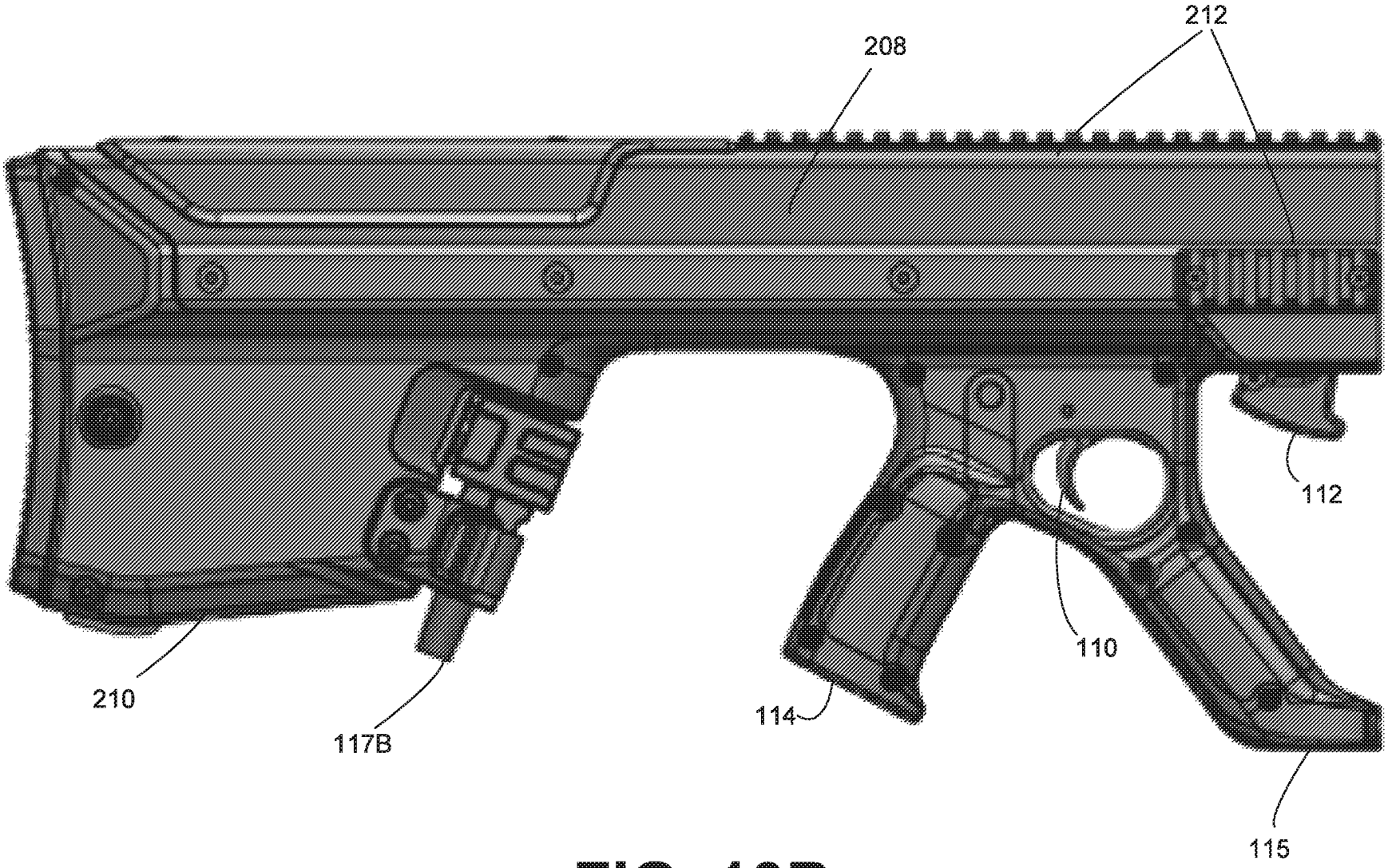
FIG. 10B illustrates a three-dimensional right-side view of the dual-grip configuration of the portable countermeasure device of FIGS. 9A-9B in accordance with one embodiment of the subject application.
Figure 10C:
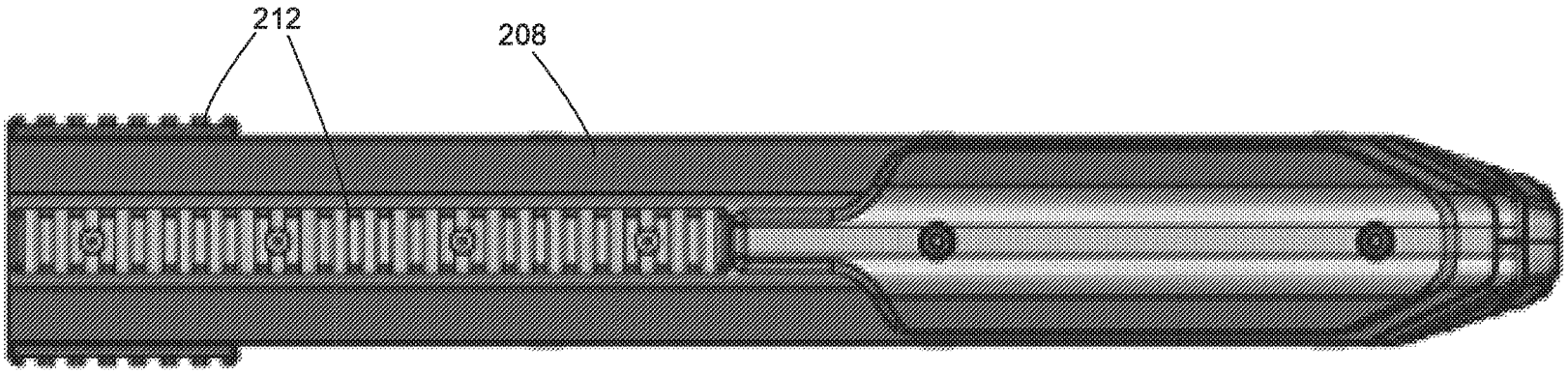
FIG. 10C illustrates a three-dimensional top view of the dual-grip configuration of the portable countermeasure device of FIGS. 9A-9B in accordance with one embodiment of the subject application.
Figure 10D:
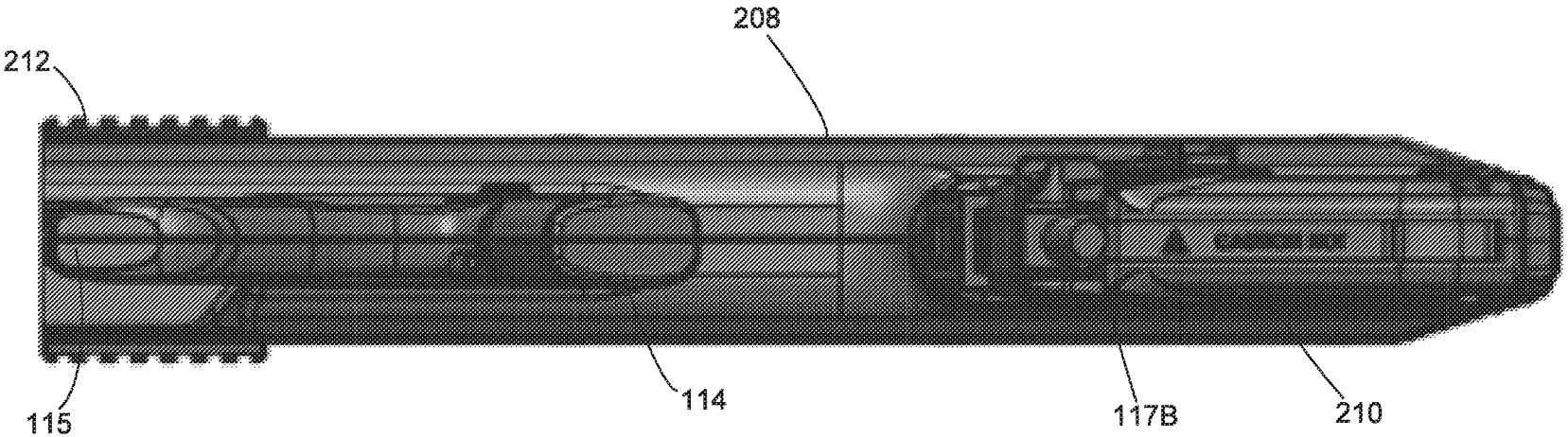
FIG. 10D illustrates a three-dimensional bottom view of the dual-grip configuration of the portable countermeasure device of FIGS. 9A-9B in accordance with one embodiment of the subject application.
Figure 10F:
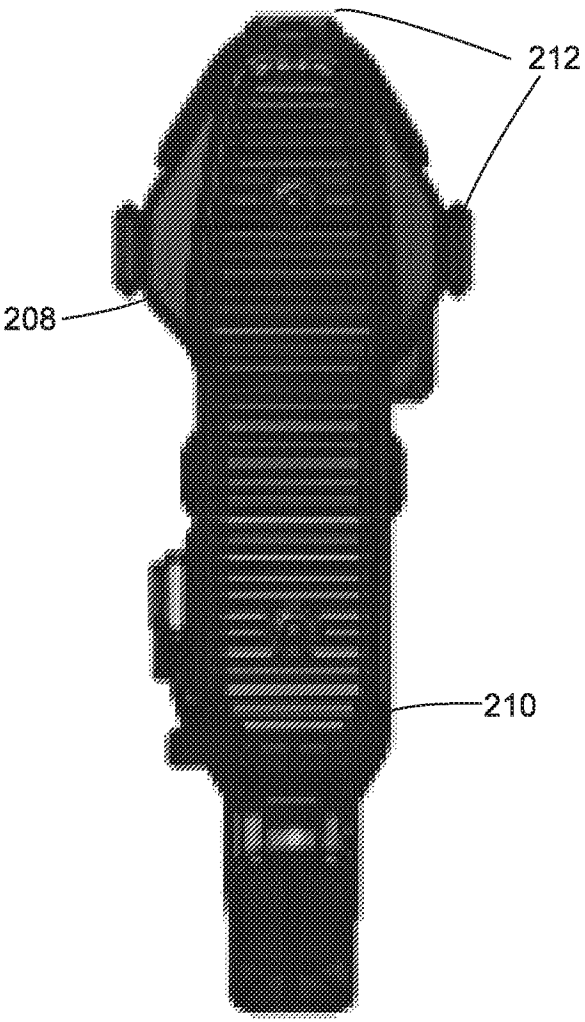
FIG. 10F illustrates a three-dimensional front view of the dual-grip configuration of the portable countermeasure device of FIGS. 9A-9B in accordance with one embodiment of the subject application.
Figure 10E:
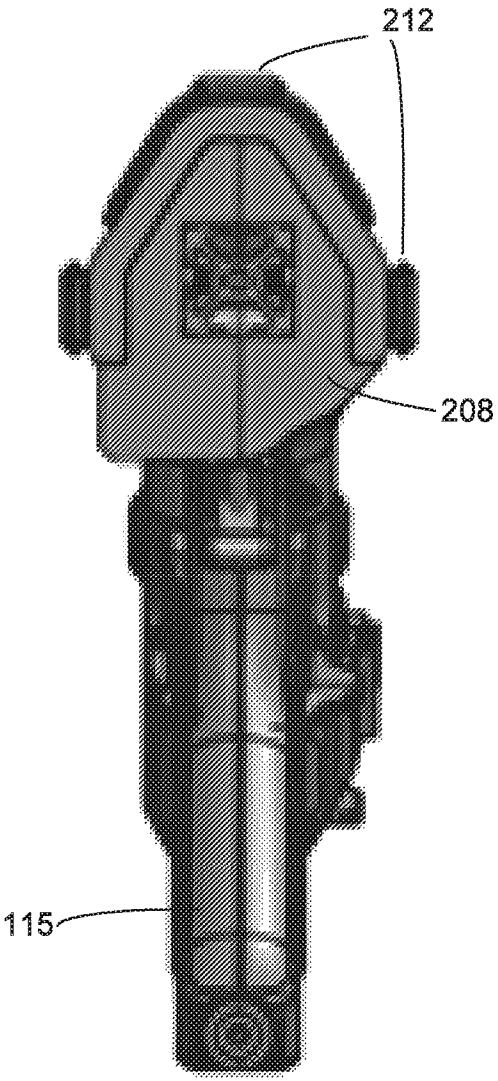
FIG. 10E illustrates a three-dimensional rear view of the dual-grip configuration of the portable countermeasure device of FIGS. 9A-9B in accordance with one embodiment of the subject application.
Figure 11A:
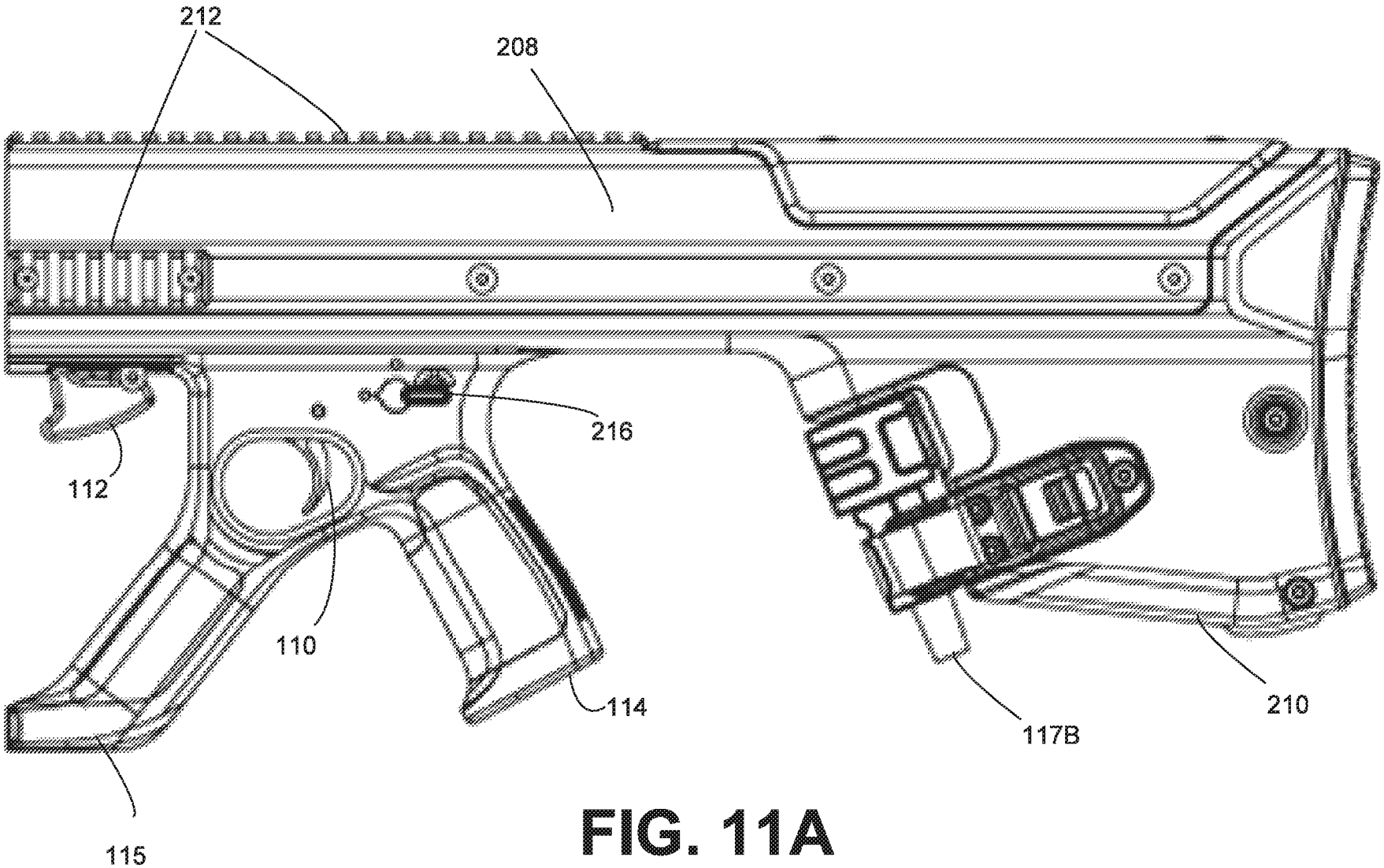
FIG. 11A illustrates a left-side view of the dual-grip configuration of the portable countermeasure device of FIGS. 9A-9B in accordance with one embodiment of the subject application.
Figure 11B:
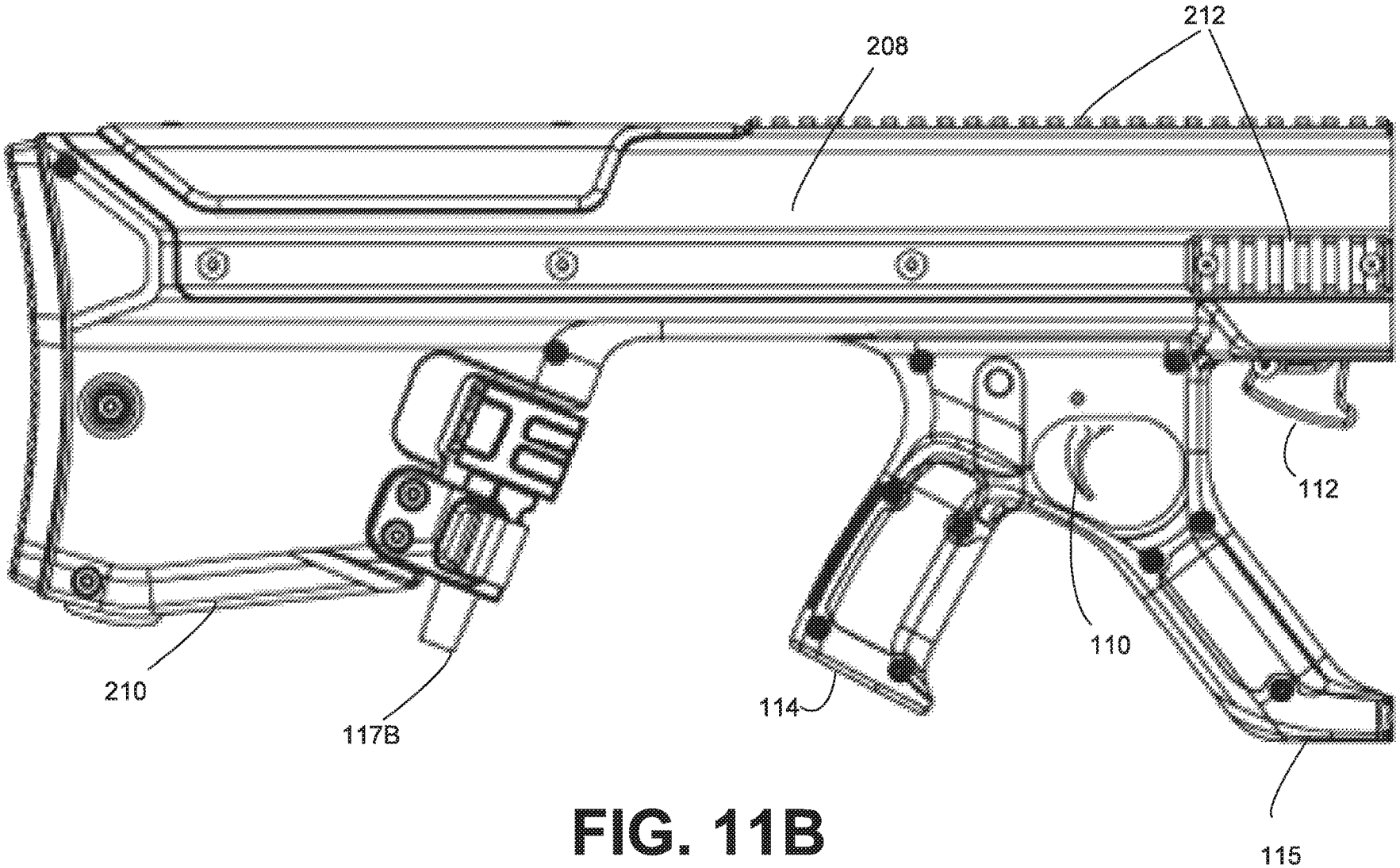
FIG. 11B illustrates a right-side view of the dual-grip configuration of the portable countermeasure device of FIGS. 9A-9B in accordance with one embodiment of the subject application.
Figure 11C:
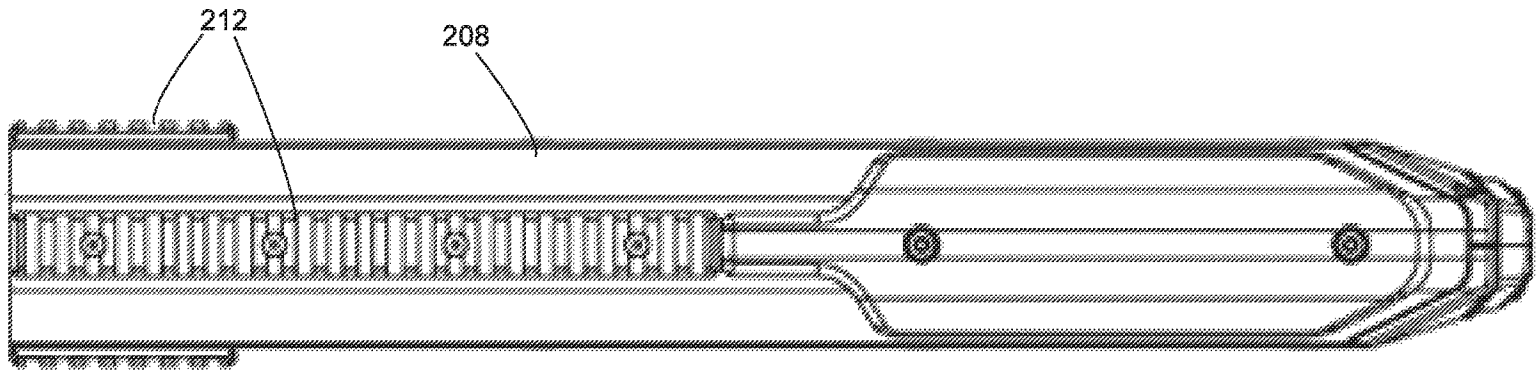
FIG. 11C illustrates a top view of the dual-grip configuration of the portable countermeasure device of FIGS. 9A-9B in accordance with one embodiment of the subject application.
Figure 11D:
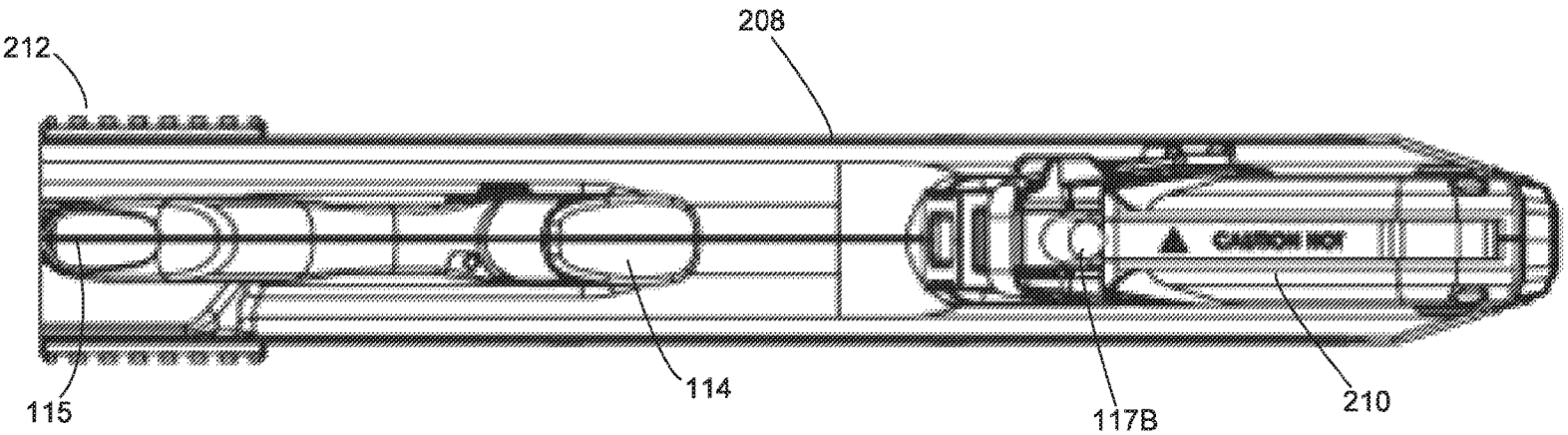
FIG. 11D illustrates a bottom view of the dual-grip configuration of the portable countermeasure device of FIGS. 9A-9B in accordance with one embodiment of the subject application.
Figure 11F:
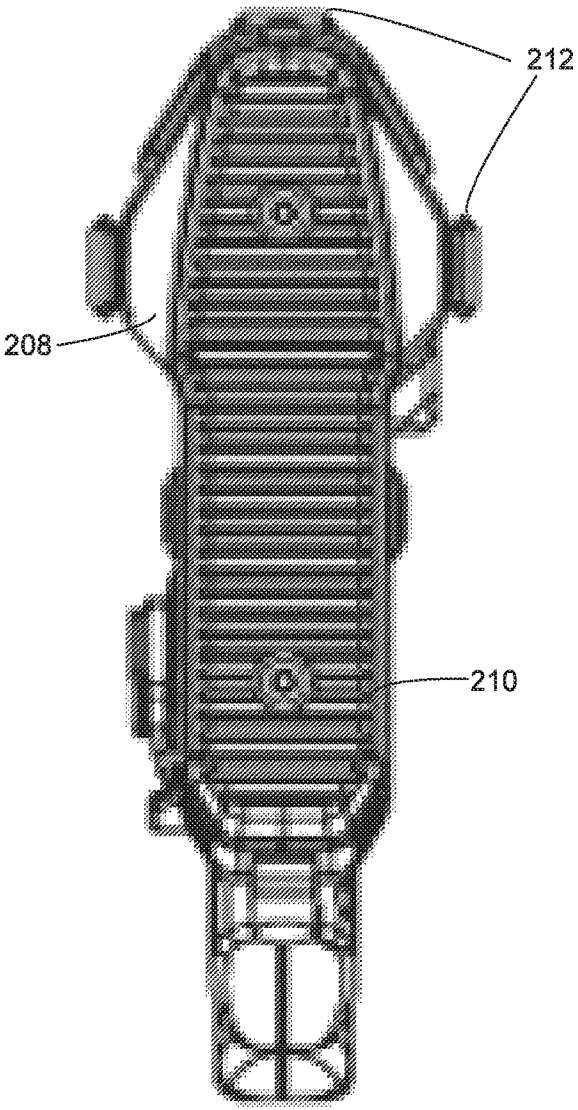
FIG. 11F illustrates a front view of the dual-grip configuration of the portable countermeasure device of FIGS. 9A-9B in accordance with one embodiment of the subject application.
Figure 11E:
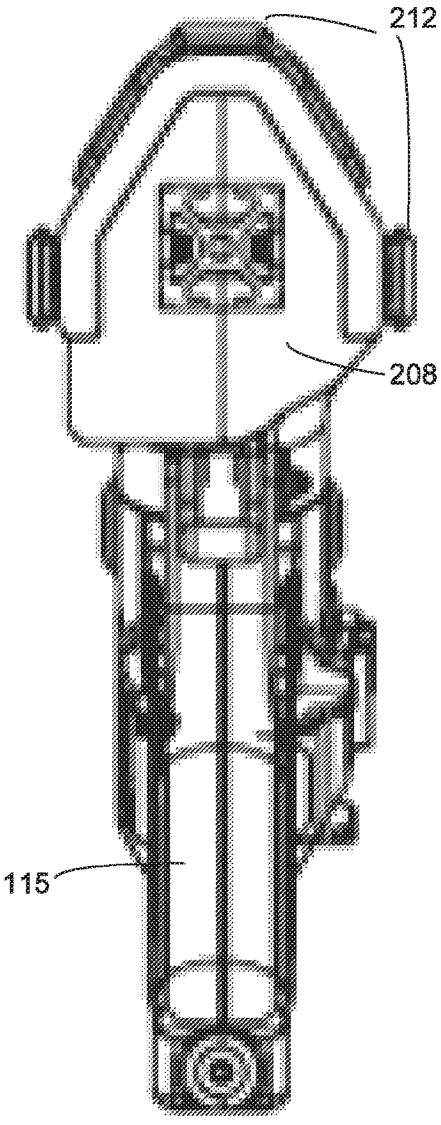
FIG. 11E illustrates a rear view of the dual-grip configuration of the portable countermeasure device of FIGS. 9A-9B in accordance with one embodiment of the subject application.

The portable countermeasure device 200 of FIGS. 2A-3F utilizes dual grips 114 and 115 with corresponding dual activators 110 and 112 for respective disruption of control signals and GPS/navigation signals. FIGS. 9A and 9B provide close-up views of an example implementation of the dual grips 114 and 115 with associated dual activators 110 and 112 on the portable countermeasure device 200. The rendering in FIGS. 9A-9B further illustrate the dual grips 114 and 115 of the portable countermeasure device 200. As shown, the first grip 114 is configured to enable the operator to engage the first trigger 110. The cantilevered or forward-angled second grip 115 is configured to enable the operator to engage the second trigger 112, without requiring the operator to adjust his stance or wielding of the device 200, i.e., the operator does not have to move his hands from the grips 114 or 115 in order to engage the disruption components 104. In accordance with one embodiment, the portable countermeasure device 200 may be modular, rugged, and portable, capable of being transported by a soldier or law enforcement official without damage to the antenna 202-206, the body 208, optics, rail attachments, etc., may be disassembled and stored in the backpack depicted in FIG. 5.

FIGS. 10A-10F provide a three-dimensional view of the body 208 of the portable countermeasure device 200 in accordance with one embodiment of the subject application. FIGS. 11A-11F provide a further detailed line view of the body 208 of the portable countermeasure device 200 in accordance with the embodiment of FIGS. 10A-10F. As will be appreciated, the body 208, comprising the dual grips 114 and 115, buttstock 203, rails 212, dual-triggers 110-112, and connection 117B is illustrated without the reflector 214, or antennae 202-206. Accordingly, the body 208 comprising the above-identified components, as illustrated in FIGS. 10A-11F is capable of adaptation to a plurality of weapons, including, for example and without limitation, low-recoil ballistic weapons, directed energy weapons, and the like. It will be understood that the example implementations of FIGS. 1-11F are non-limiting examples of possible firearm-like form factors implemented as the portable countermeasure device 100 according to the disclosures contained herein.

FIGS. 12A-12G provide a three-dimensional view of the body 102 of the portable countermeasure device 100 of the exemplary embodiment of FIG. 1. The exemplary embodiment of FIGS. 12A-12G illustrate a single trigger 110 system, at least one antenna 122A-C and buttstock 113, with a buttstock cavity enclosed by buttstock door 118.

As explained above, in some embodiments disclosed herein, the countermeasure device 100, includes a plate 123 with at least one antenna attached thereto. The plate 123 is removable from the body 102 of the countermeasure device 100 and allows for another similarly shaped plate to removably connect thereto in order to switch antenna of the countermeasure device 100 (in case the first set of antennae are damaged). In some embodiments, the countermeasure device 100 includes at least one removable side panel 125A, 125B. The at least one removable side panel 125 may be attached to the body 102 by at least one fastener. In some embodiments, the at least one removable side panel 125 is secured to the body 102 via a locking fastener 129. Unlocking the locking fastener 129 and removing the at least one removable side panel 125 provides access to the internal components shown in the cross section of FIG. 1. In some embodiments, upon removal of the at least one removable side panel 125, the operator has access to at least one fastener for securing the plate 123 to the body 102. It is to be appreciated that each the left and right side may include a removable side panel, and that one or both panels may each be secured to the body 102 via separate fasteners. Furthermore, either panel or both panels may be removed to provide access to the internal components (e.g., amplifies 108, signal source 106, etc.).

Figure 13A:
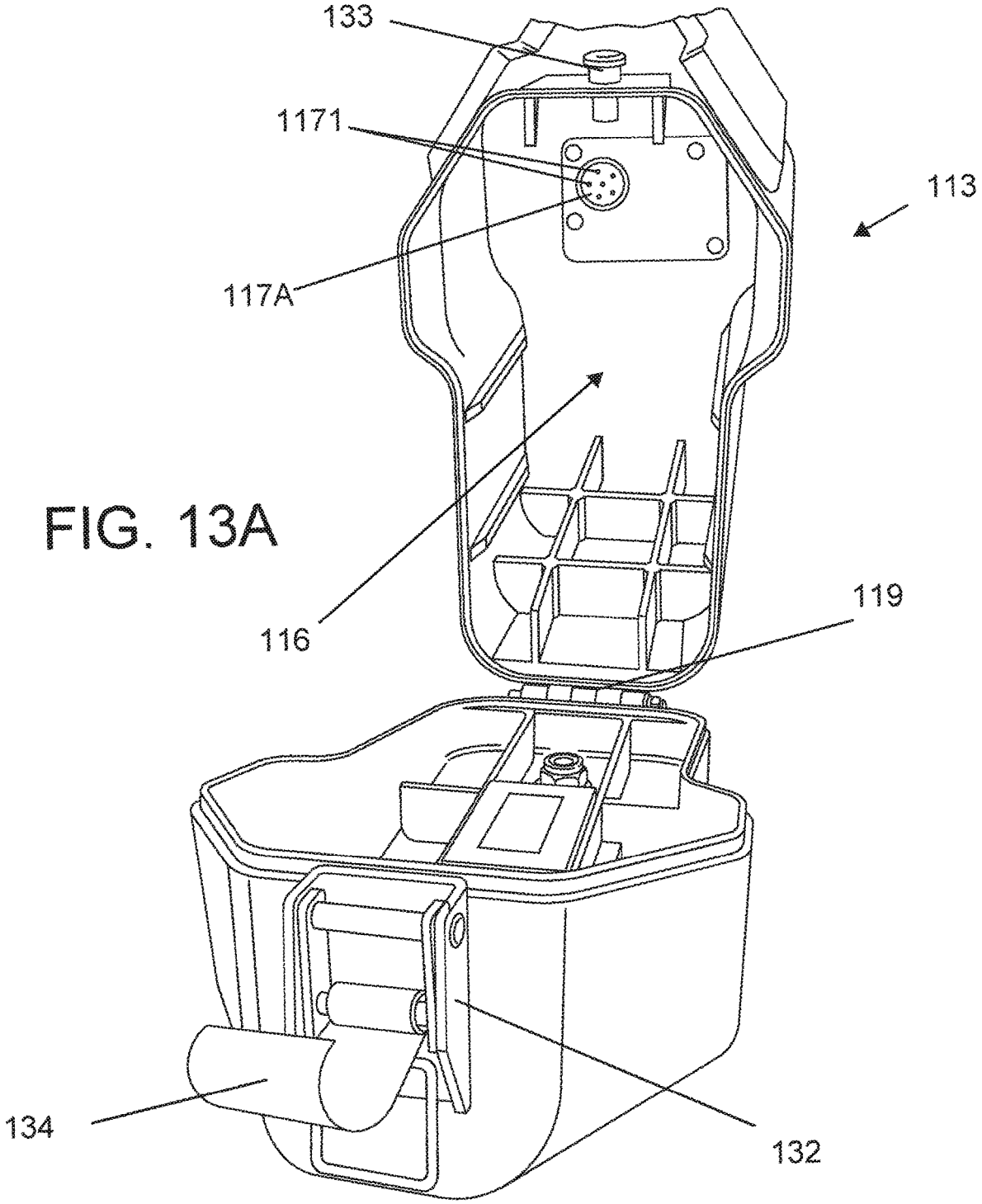
FIG. 13A illustrates a rear perspective view of a buttstock according to one embodiment of the subject application.
Figure 13B:
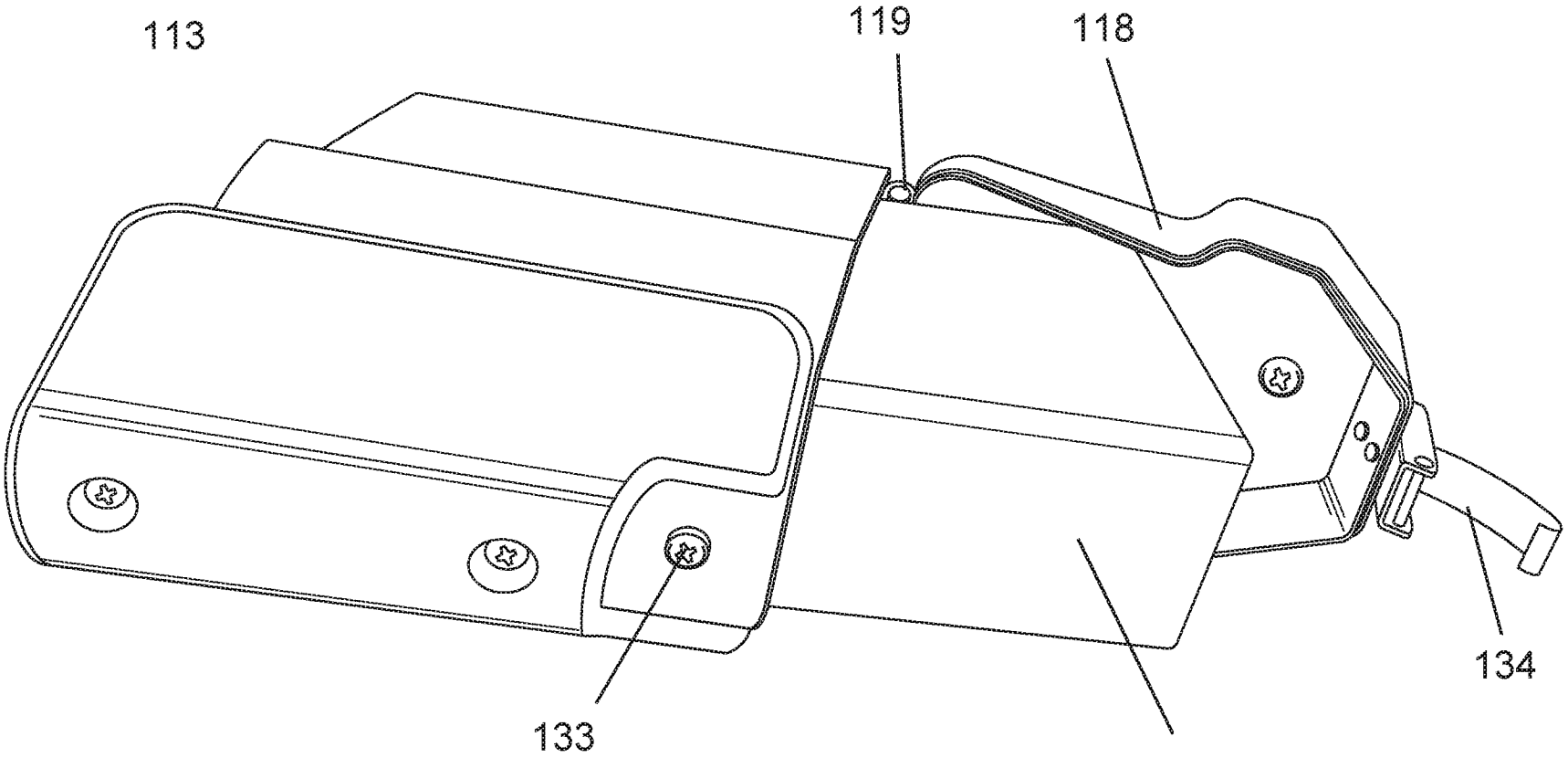
FIG. 13B illustrates a top perspective view of a buttstock and battery according to one embodiment of the subject application.
Figure 13C:
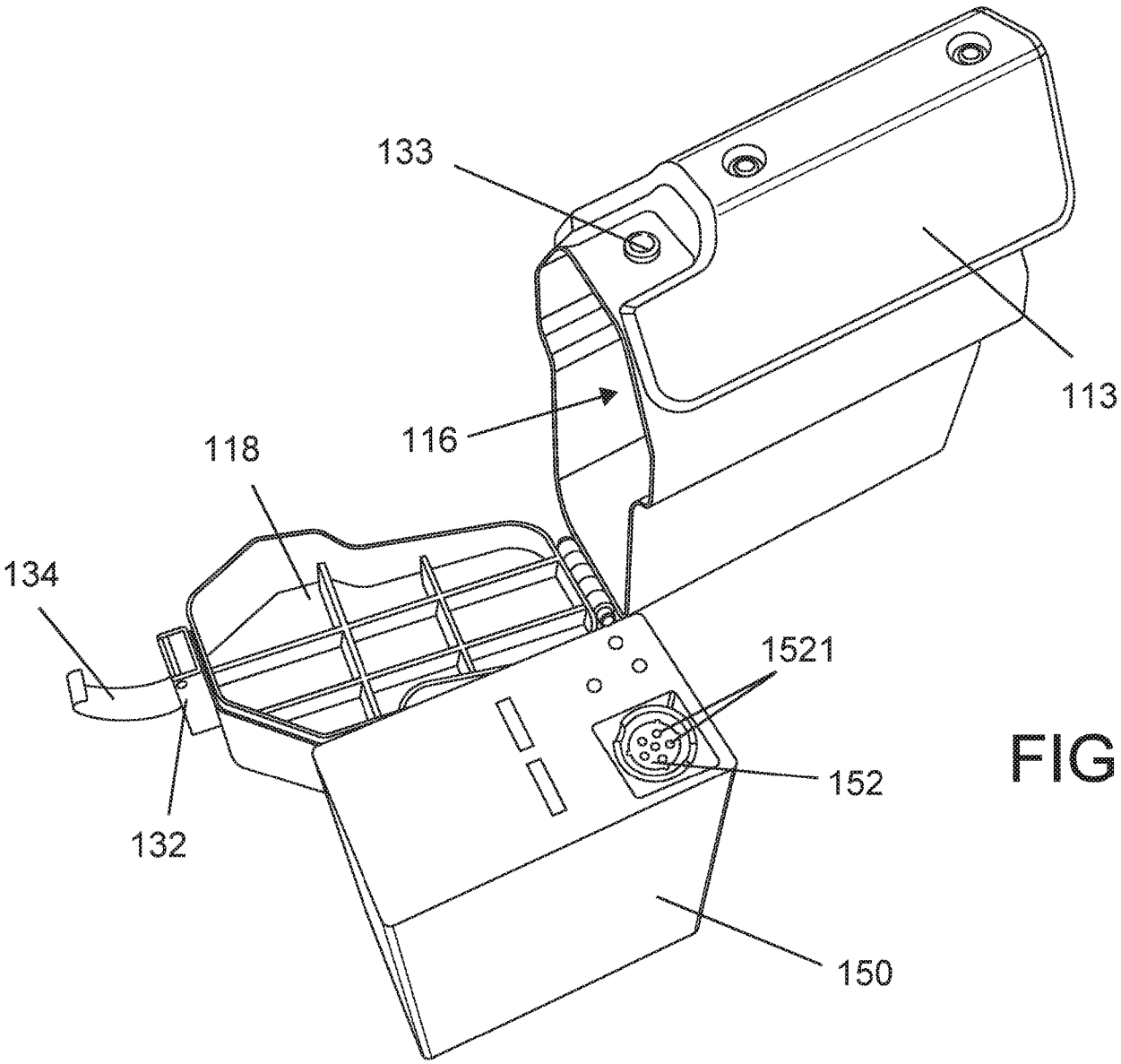
FIG. 13C illustrates a perspective view of a buttstock according to one embodiment of the subject application.

FIGS. 13A-13C provide a three-dimensional view of a buttstock 113 accordance with one embodiment of the subject application. FIG. 13A illustrates the buttstock 113 in an open position. That is, the buttstock door 118 is pivoted about the hinge 119 such that access to the buttstock cavity 116 is provided. Also illustrated is coupling 117A configured to engage a corresponding connector 152 associated with a power source, such as replaceable battery 150. For example and without limitation, the coupling 117A may include a plurality of pins 1171 (six pins are illustrated). The replaceable battery 150, likewise may include a corresponding connector 152 having a plurality of apertures 1521 each configured to receive and electronically connect to a pin 1171 of coupling 117A. As illustrated in FIG. 13B, the replaceable battery 150 may be inserted into the buttstock cavity 116, such that the coupling 117A engages the battery connector 152, providing electrical power to the countermeasure device 100. In some embodiments and with continued reference to FIGS. 13A-13C, the buttstock 113 includes a buttstock fastener 132. The buttstock fastener 132 is configured to secure the buttstock door 118 in a closed position such that the buttstock door does not unexpectedly open allowing the contents of the buttstock cavity 116 to fall out. In some embodiments, the buttstock fastener 132 is configured to engage a fastener structure 133 located on a top portion of the buttstock 113. As illustrated in FIG. 13A-C the buttstock fastener 132 includes a spring clip 134. When the buttstock door 118 is in the closed position, the spring clip 134 of the fastener 132 may engage a catch structure 133 such that the buttstock door 118 is urged into a secure closed position.

It is to be appreciated that in connection with the particular illustrative embodiments presented herein certain structural and/or function features are described as being incorporated in defined elements and/or components. However, it is contemplated that these features may, to the same or similar benefit, also likewise be incorporated in other elements and/or components where appropriate. It is also to be appreciated that different aspects of the exemplary embodiments may be selectively employed as appropriate to achieve other alternate embodiments suited for desired applications, the other alternate embodiments thereby realizing the respective advantages of the aspects incorporated therein.

It is also to be appreciated that particular elements or components described herein may have their functionality suitably implemented via hardware, software, firmware or a combination thereof. Additionally, it is to be appreciated that certain elements described herein as incorporated together may under suitable circumstances be stand-alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described and/or shown herein as distinct from one another may be physically or functionally combined where appropriate.

In short, the present specification has been set forth with reference to preferred embodiments. Obviously, modifications and alterations will occur to others upon reading and understanding the present specification. It is intended that the invention be construed as including all such modifications and alterations insofar as they come within the scope of the appended claims or the equivalents thereof. That is to say, it will be appreciated that various of the above-disclosed and other features and functions, or alternatives thereof, may be desirably combined into many other different systems or applications, and also that various presently unforeseen or unanticipated alternatives, modifications, variations or improvements therein may be subsequently made by those skilled in the art which are similarly intended to be encompassed by the following claims.

What is claimed is:

1. A handheld countermeasure device, comprising:

a hand-held form factor body;

a plurality of disruption components comprising at least one signal generator configured to generate a disruptive signal to instruct at least one target to perform an action; and at least one directional antenna configured to emit the disruptive signal.

2. The handheld countermeasure device of claim 1, wherein the disruptive signal is configured to cause the at least one target to return to a home location.

3. The handheld countermeasure device of claim 1, further comprising:

a first activator in communication with the plurality of disruption components, the first activator being configured to initiate generation of the disruptive signal; and a second activator in communication with a plurality of second disruption components, the second activator being configured to initiate generation of a second disruptive signal.

4. The handheld countermeasure device of claim 1, further comprising at least one amplifier coupled to the at least one signal generator, wherein the at least one amplifier is configured to amplify the disruptive signal being emitted.

5. The handheld countermeasure device of claim 1, further comprising a body including a first grip and a second grip, the second grip adjacent the first grip located on a bottom portion of the body.

6. The handheld countermeasure device of claim 1, wherein the plurality of disruption components are located external to the hand-held form factor body.

7. The handheld countermeasure device of claim 1, wherein the at least one target comprises at least one of: an improvised explosive device (IED), a drone, a cellular phone, a navigation device, and a remote controller.

8. A man-portable countermeasure device, comprising:

a hand-held form factor body;

a plurality of disruption components comprising at least one signal generator configured to generate a disruptive alternative command signal to at least one aerial target; and at least one directional antenna configured to emit the disruptive alternative command signal.

9. The man-portable countermeasure device of claim 8, wherein the man-portable countermeasure device is configured to provide visual feedback in accordance with emission the disruptive alternative command signal.

10. The man-portable countermeasure device of claim 8, wherein the disruptive alternative command signal is configured to cause the at least one aerial target to return to a home location or landing.

11. The man-portable countermeasure device of claim 8, wherein the disruptive alternative command signal comprises a false data signal.

12. The man-portable countermeasure device of claim 8, wherein the at least one directional antenna is hot swappable.

13. The man-portable countermeasure device of claim 8, wherein the man-portable countermeasure device is configured to adjust a maximum range of the disruptive alternative command signal based on an amount of power supplied to the plurality of disruption components.

14. A man-portable countermeasure device, comprising:

a plurality of disruption components comprising at least one signal generator configured to generate a disruptive signal to at least one aerial target, the disruptive signal comprising an alternative command signal;

at least one amplifier coupled to the at least one signal generator, wherein the at least one amplifier is configured to amplify the disruptive signal to generate an amplified disruptive signal; and at least one directional antenna configured to emit the amplified disruptive signal.

15. The man-portable countermeasure device of claim 14, wherein the amplified disruptive signal is configured to disrupt at least one of: a control of the at least one aerial target and a navigation of the at least one aerial target.

16. The man-portable countermeasure device of claim 14, further comprising at least one haptic feedback component, the at least one haptic feedback component being configured to generate haptic feedback in accordance with emission of the amplified disruptive signal.

17. The man-portable countermeasure device of claim 14, wherein the at least one directional antenna is further configured to emit the amplified disruptive signal as a cone shape.

18. The man-portable countermeasure device of claim 17, wherein the cone shape comprises a range of at least one of: 0 to 180 degrees, 0 to 120 degrees, 0 to 90 degrees, 0 to 45 degrees, and 20 to 30 degrees.

19. The man-portable countermeasure device of claim 14, wherein the at least one directional antenna comprises a multi-directional antenna.

20. The man-portable countermeasure device of claim 19, wherein a count of directions of the multi-directional antenna corresponds to a count of disruptive signals that the man-portable countermeasure device is configured to generate.

* * * * *